US011384702B2

(12) United States Patent
Nakano

(10) Patent No.: US 11,384,702 B2
(45) Date of Patent: Jul. 12, 2022

(54) VARIABLE COMBUSTION CYLINDER RATIO CONTROL DEVICE AND METHOD

(71) Applicant: TOYOTA JIDOSHA KABUSHIKI KAISHA, Toyota (JP)

(72) Inventor: Tomohiro Nakano, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 158 days.

(21) Appl. No.: 16/013,126

(22) Filed: Jun. 20, 2018

(65) Prior Publication Data

US 2019/0048814 A1 Feb. 14, 2019

(30) Foreign Application Priority Data

Aug. 8, 2017 (JP) ..... JP2017-153145

(51) Int. Cl.
*F02D 41/00* (2006.01)
*F02D 41/12* (2006.01)

(52) U.S. Cl.
CPC ..... *F02D 41/0087* (2013.01); *F02D 41/123* (2013.01); *F02D 2200/101* (2013.01); *F02D 2200/1012* (2013.01); *F02D 2250/12* (2013.01); *F02D 2250/21* (2013.01)

(58) Field of Classification Search
CPC ..... F02D 41/0087; F02D 41/123; F02D 2200/101; F02D 2200/1012; F02D 2250/12; F02D 2250/21
USPC ..... 123/350
See application file for complete search history.

(56) References Cited

U.S. PATENT DOCUMENTS 5,327,856 A * 7/1994 Schroeder ..... F01L 13/0005 251/129.05
5,555,871 A * 9/1996 Gopp ..... F02D 17/02 123/481
6,938,598 B1 * 9/2005 Lewis ..... F02D 41/0002 123/179.3
8,402,942 B2 * 3/2013 Tripathi ..... F02P 5/1512 701/115
9,200,575 B2 12/2015 Shost
2005/0022509 A1 * 2/2005 Fukusako ..... F01N 9/005 60/284

(Continued)

FOREIGN PATENT DOCUMENTS

CN 106715872 A 5/2017
JP 2018-100658 A 6/2018

*Primary Examiner* — Logan M Kraft
*Assistant Examiner* — John D Bailey
(74) *Attorney, Agent, or Firm* — Oliff PLC

(57) ABSTRACT

A variable combustion cylinder ratio control device includes a target ratio setting section and a pattern determining section. The pattern determining section determines a target deactivation interval as a subsequent deactivation interval when the difference between a current deactivation interval and the target deactivation interval is less than or equal to X cylinders, and determines, as the subsequent deactivation interval, an interval closer to the target deactivation interval than the current deactivation interval by X cylinders when the difference between the current deactivation interval and the target deactivation interval exceeds X cylinders. The value of X is a natural number and a variable value that varies in accordance with the operating state of the engine.

12 Claims, 5 Drawing Sheets

(56) References Cited

U.S. PATENT DOCUMENTS

2005/0199220 A1* 9/2005 Ogiso ..... F02D 41/0087 123/90.11
2005/0204727 A1* 9/2005 Lewis ..... F01L 9/20 60/285
2005/0205020 A1* 9/2005 Lewis ..... F02D 13/06 123/21
2005/0205028 A1* 9/2005 Lewis ..... F02D 41/221 123/90.11
2005/0205037 A1* 9/2005 Lewis ..... F02D 13/0215 123/179.16
2005/0205038 A1* 9/2005 Lewis ..... F02D 41/0087 123/179.18
2005/0205047 A1* 9/2005 Lewis ..... F02D 13/0203 123/198 F
2005/0205060 A1* 9/2005 Michelini ..... F01L 9/20 123/432
2005/0205061 A1* 9/2005 Lewis ..... F02D 13/06 123/90.11
2005/0205063 A1* 9/2005 Kolmanovsky ..... F01L 9/20 123/436
2005/0205074 A1* 9/2005 Gibson ..... F02D 41/1454 123/673
2005/0209045 A1* 9/2005 Lewis ..... F02D 13/0203 477/107
2010/0037857 A1* 2/2010 Tripathi ..... F02D 41/266 123/406.47
2010/0100299 A1* 4/2010 Tripathi ..... F02D 41/0087 701/102
2011/0213541 A1* 9/2011 Tripathi ..... F02D 41/0087 701/102
2011/0295489 A1* 12/2011 Ma ..... F02D 41/0002 701/103
2014/0053802 A1* 2/2014 Rayl ..... F02D 41/0087 123/350
2014/0053804 A1* 2/2014 Rayl ..... F02D 41/0087 123/350
2014/0069374 A1* 3/2014 Matthews ..... F02D 41/18 123/350
2014/0069376 A1* 3/2014 Matthews ..... F02D 17/02 123/350
2014/0069377 A1* 3/2014 Brennan ..... F02D 17/02 123/350
2014/0069378 A1* 3/2014 Burleigh ..... F02D 17/02 123/350
2014/0090623 A1* 4/2014 Beikmann ..... F02D 13/06 123/350
2014/0116379 A1* 5/2014 Maruyama ..... G05G 1/30 123/349
2014/0261316 A1* 9/2014 Shost ..... F02D 17/02 123/349
2014/0261317 A1* 9/2014 Loucks ..... F02D 19/0623 123/350
2015/0094930 A1* 4/2015 Levijoki ..... F02D 41/0087 701/102
2015/0354470 A1* 12/2015 Li ..... F02D 41/1406 701/54
2015/0377171 A1* 12/2015 Mahadevan ..... F02D 41/0082 123/294
2016/0017824 A1* 1/2016 Touchette ..... F02D 17/02 123/481
2016/0032845 A1* 2/2016 Boyer ..... F02D 17/02 123/58.1
2016/0053697 A1* 2/2016 Pirjaberi ..... F02P 5/1504 123/406.12
2016/0102616 A1* 4/2016 McConville ..... F02D 41/3064 123/334
2016/0108798 A1* 4/2016 VanDerWege ..... F02B 37/12 60/602
2016/0108828 A1* 4/2016 Glugla ..... F02D 35/025 123/344
2016/0108834 A1* 4/2016 McConville ..... F02D 13/0219 123/90.15
2016/0115878 A1* 4/2016 VanDerWege ..... F02D 41/0087 123/333
2016/0115884 A1* 4/2016 VanDerWege ..... F02D 41/1446 123/481
2016/0146121 A1* 5/2016 Carlson ..... F01N 11/007 60/276
2016/0146138 A1* 5/2016 Beikmann ..... F02D 41/0087 701/54
2016/0252033 A1* 9/2016 Dye ..... F02D 41/3005 123/481
2017/0234253 A1* 8/2017 Serrano ..... F01N 11/007 123/436
2017/0350332 A1* 12/2017 Martin ..... F02D 41/0087
2017/0356375 A1* 12/2017 Glugla ..... B60W 30/1882
2018/0171880 A1* 6/2018 Nakano ..... F02D 41/0085
2018/0171909 A1* 6/2018 Richards ..... F02D 41/021
2018/0194356 A1* 7/2018 Richards ..... B60W 30/20
2018/0238248 A1* 8/2018 Karnik ..... F02D 37/02
2018/0238249 A1* 8/2018 Soliman ..... F02D 41/0087
2018/0363566 A1* 12/2018 Banker ..... F02D 17/02
2019/0211761 A1* 7/2019 Ranga ..... F02D 41/1401

* cited by examiner

VARIABLE COMBUSTION CYLINDER RATIO CONTROL DEVICE AND METHOD

CROSS REFERENCE TO RELATED APPLICATION

This application claims priority from Japanese Patent Application No. 2017-153145, filed on Aug. 8, 2017, the disclosure of which is incorporated herein by reference in its entirety.

BACKGROUND

The present disclosure relates to a variable combustion cylinder ratio control device and method configured to variably control the combustion cylinder ratio of an engine during an intermittent deactivation operation, in which cylinder deactivation is intermittently executed.

U.S. Pat. No. 9,200,575 discloses a conventional variable combustion cylinder ratio control device. This control device does not fix but dynamically changes the cylinders in which combustion is suspended, thereby achieving a variety of combustion cylinder ratios.

The above publication discloses one example of cylinder deactivation patterns for achieving predetermined combustion cylinder ratios. In one example of the patterns, one cylinder is deactivated after combustion is executed consecutively in five cylinders. Thereafter, combustion is executed in one cylinder, and then one cylinder is deactivated. The cylinder deactivation executed in this pattern sets the combustion cylinder ratio to 75% (6/8). This pattern of cylinder deactivation includes a period in which the cylinder deactivation interval is equivalent to five cylinders and a period in which the cylinder deactivation interval is equivalent to one cylinder.

The engine speed temporarily drops in correspondence with cylinder deactivation. The amount of increase in the engine speed after cylinder deactivation is great in a period in which the cylinder deactivation interval is long and is small in a period in which the interval is short. Therefore, if there a period in which the cylinder deactivation interval is long and a period in which the cylinder deactivation interval is short, the fluctuation of the engine speed increases. In order to reduce such engine speed fluctuation, torque management needs to be executed for each cylinder. That is, in a period in which the cylinder deactivation interval is short, the torque generation amount of each of the cylinders that execute combustion must be made greater than that in a period in which the cylinder deactivation interval is long, so that the amount of increase in the engine speed until the subsequent cylinder deactivation is made uniform.

Furthermore, when the combustion cylinder ratio is variably controlled, the pattern of cylinder deactivation changes in accordance with changes of that ratio. This complicates the individual torque management for each cylinder, which is executed to reduce engine speed fluctuation.

Accordingly, it is an objective of the present disclosure to provide a variable combustion cylinder ratio control device and method that are capable of reducing in a favorable manner an engine speed fluctuation that is caused by changes of the cylinder deactivation interval when the combustion cylinder ratio is variably controlled.

SUMMARY

To achieve the foregoing objective, a variable combustion cylinder ratio control device is configured to variably control a combustion cylinder ratio of an engine during an intermittent deactivation operation, in which cylinder deactivation is intermittently executed. The variable control device includes a target ratio setting section, which is configured to set, as a target ratio, a combustion cylinder ratio that is achievable by repeating cylinder deactivation at regular intervals. When the value of the target ratio, which is set in the above-described manner, is changed, changing the cylinder deactivation interval allows the combustion cylinder ratio to be changed from the target ratio before the change to the target ratio after the change.

The cylinder deactivation interval that achieves a current combustion cylinder ratio is defined as a current deactivation interval, and the cylinder deactivation interval from execution of the cylinder deactivation at the current deactivation interval to execution of the subsequent cylinder deactivation is defined as a subsequent deactivation interval. Also, the cylinder deactivation interval that achieves the target ratio is defined as a target deactivation interval. The variable control device includes a pattern determining section, which is configured to determine the subsequent deactivation interval in the following manner. That is, the pattern determining section determines a target deactivation interval as the subsequent deactivation interval when the difference between a current deactivation interval and the target deactivation interval is less than or equal to X cylinders, and determines, as the subsequent deactivation interval, an interval closer to the target deactivation interval than the current deactivation interval by X cylinders when the difference exceeds X cylinders. The value of X is a natural number and a variable value that varies in accordance with the operating state of the engine.

If the subsequent deactivation interval is set in this manner, the interval of cylinder deactivation is maintained constant until the target ratio is changed in a condition in which the current deactivation interval matches the target deactivation interval. That is, while the combustion cylinder ratio is constant, the cylinder deactivation interval is maintained constant.

Also, if the cylinder deactivation interval is set in the above-described manner, the combustion cylinder ratio is changed with a single change of the cylinder deactivation interval being less than or equal to X cylinders. That is, when a change of the target ratio is executed that requires a change of the cylinder deactivation interval exceeding X cylinders, engine speed fluctuation due to the change of the cylinder deactivation interval is suppressed by changing the cylinder deactivation interval gradually in a plurality of times.

If merely suppression of the engine speed fluctuation due to the change of the cylinder deactivation interval is considered, it is only needed to reduce reduce the value of X, that is, the amount of a single change of the cylinder deactivation interval. This, however, extends the time required to change the combustion cylinder ratio significantly to change the cylinder deactivation interval greatly, deteriorating the responsiveness of the variable control of the combustion cylinder ratio. On the other hand, depending on the operating state of the engine, even if the cylinder deactivation interval is changed to a certain extent at one time, the engine speed fluctuation caused by the change may remain within an allowable range. Therefore, if the combustion cylinder ratio is changed in the above-described manner while changing the maximum change amount of the cylinder deactivation interval at one time, it is possible to suppress the engine speed fluctuation while suppressing deterioration of responsiveness. Therefore, the above-described variable combustion cylinder ratio control device is capable of reducing engine speed fluctuation caused by changes in the cylinder deactivation interval when the variable control of the combustion cylinder ratio is executed.

When the engine speed is low, the combustion cycle becomes long, and the change of the engine speed due to the change of the cylinder deactivation interval also gently occurs over time. Therefore, the engine speed fluctuation caused by changing the cylinder deactivation interval becomes gentle as the engine speed decreases. The lower the engine speed, the greater the change amount of the allowable cylinder deactivation interval becomes. Therefore, the pattern determining section preferably sets the subsequent deactivation interval such that, when the engine speed is low, X has a greater value than when the engine speed is high, that is, the maximum change amount of the cylinder deactivation interval at one time becomes greater.

In addition, the rate of change of the average torque of the engine (the generated torque per unit time) due to change of the cylinder deactivation interval decreases as the cylinder deactivation interval before change increases. Thus, the greater the current deactivation interval, the greater the allowable change amount of the cylinder deactivation interval becomes. Therefore, the pattern determining section preferably sets the subsequent deactivation interval such that, when the current deactivation interval is great, X has a greater value than when the current deactivation interval is small, that is, the maximum change amount of the cylinder deactivation interval at one time becomes greater.

Furthermore, when the engine speed changes greatly, for example, at acceleration or deceleration, that is, when the engine speed is changing abruptly, the speed fluctuation accompanying a change of the cylinder deactivation interval is not likely to lead to the deterioration of the drivability. Thus, the greater the change of the engine speed, the greater the allowable change amount of the cylinder deactivation interval becomes. Therefore, the pattern determining section of the above-described variable combustion cylinder ratio control device preferably sets the subsequent deactivation interval such that, when the change of the engine speed is great, X has a greater value than when the change is small, that is, the maximum change amount of the cylinder deactivation interval at one time becomes greater.

If it is assumed that the torque generated by combustion in one cylinder is constant, the torque generated by the engine per unit time during the intermittent deactivation operation (hereinafter, referred to as the engine average torque) is proportional to the combustion cylinder ratio. Thus, the rate of change of the average torque of the engine when changing the cylinder deactivation interval is proportional to the rate of change of the combustion cylinder ratio before and after the change. Therefore, if the value of X is a value at which the rate of change of the combustion cylinder ratio when changing the cylinder deactivation interval from the current deactivation interval to the subsequent deactivation interval is less than the preset limit value, the rate of change of the average torque of the engine with a change of the cylinder deactivation interval is also limited to be less than the limit value.

The minimum amount is determined for the change amount of the cylinder deactivation interval and the rate of change of the combustion cylinder ratio may reach or exceed the limit value by changing the minimum amount of the cylinder deactivation intervals. In that case, it is preferable to change the cylinder deactivation interval by that minimum amount. That is, the setting of the subsequent deactivation interval by the pattern determining section of the above-described variable combustion cylinder ratio control device is preferably executed such that the value of X becomes the greater one of the value at which the rate of change of the combustion cylinder ratio when the cylinder deactivation interval is changed from the current deactivation interval to the subsequent deactivation interval is less than the preset limit value and the minimum change amount of the cylinder deactivation interval.

As described above, when the engine speed is low or when the change of the engine speed is great, the allowable change amount of the cylinder deactivation interval increases. Therefore, the setting of the subsequent combustion cylinder ratio is preferably executed such that the above-mentioned limit value is greater when the engine speed is low than when the engine speed is high, or such that the above-mentioned limit value is greater when the change of the engine speed is great than when the change of the engine speed is small.

In the intermittent deactivation operation after recovering from the fuel cutoff operation, which deactivates all the cylinders of the engine, engine speed fluctuation due to resumption of combustion inevitably occurs irrespective of the value of the combustion cylinder ratio. Thus, when recovering from the fuel cutoff operation, in which all the cylinders of the engine are deactivated, the pattern determining section preferably determines, as the target deactivation period, the cylinder deactivation interval from the last cylinder deactivation in the fuel cutoff operation to the first cylinder deactivation after the recovery from the fuel cutoff operation. In such a case, the intermittent deactivation operation after the recovery from the fuel cutoff operation can be started with the combustion cylinder ratio set to the target ratio.

Even when switching between the all-cylinder combustion operation, in which combustion is executed in all the cylinders, and the intermittent deactivation operation, engine speed fluctuation occurs due to a change of the average torque. The speed fluctuation at this time becomes smaller as the combustion cylinder ratio becomes closer to one in the intermittent deactivation operation after switching from the all-cylinder combustion operation or before switching to the all-cylinder combustion operation. That is, as the cylinder deactivation interval when performing the first cylinder deactivation after switching from the all-cylinder combustion operation or the cylinder deactivation interval when performing the last cylinder deactivation before switching to the all-cylinder combustion operation is increased, it is possible to suppress the engine speed fluctuation at the time of switching. On the other hand, when the engine speed is low, the change of the engine speed due to a change of the cylinder deactivation interval gently occurs over time, so that the engine speed fluctuation at the above switching is unlikely to lead to deterioration of drivability. Therefore, the pattern determining section preferably sets, to smaller values when the engine speed is low than when the engine speed is high, the cylinder deactivation interval when executing the first cylinder deactivation after switching from the all-cylinder combustion operation, in which combustion is executed in all the cylinders, to the intermittent deactivation operation and the cylinder deactivation interval when executing the last cylinder deactivation before switching from the intermittent deactivation operation to the all-cylinder combustion operation.

Also, when the change of the engine speed is great, the engine speed fluctuation at the above switching between the all-cylinder combustion operation and the intermittent deactivation operation is unlikely to lead to deterioration of drivability. Therefore, the pattern determining section preferably sets, to smaller values when the change of the engine speed is great than when the change is small, the cylinder deactivation interval when executing the first cylinder deactivation after switching from the all-cylinder combustion operation, in which combustion is executed in all the cylinders, to the intermittent deactivation operation and the cylinder deactivation interval when executing the last cylinder deactivation before switching from the intermittent deactivation operation to the all-cylinder combustion operation.

Another aspect provides a variable combustion cylinder ratio control method that variably controls a combustion cylinder ratio of an engine during an intermittent deactivation operation, in which cylinder deactivation is intermittently performed. The method includes setting, as a target ratio, a combustion cylinder ratio that is achievable by repeating cylinder deactivation at regular intervals. A cylinder deactivation interval that achieves a current combustion cylinder ratio is defined as a current deactivation interval. A cylinder deactivation interval from execution of the cylinder deactivation at the current deactivation interval to execution of a subsequent cylinder deactivation is defined as a subsequent deactivation interval. A cylinder deactivation interval that achieves the target ratio is defined as a target deactivation interval. The method includes: determining the target deactivation interval as the subsequent deactivation interval when a difference between the current deactivation interval and the target deactivation interval is less than or equal to X cylinders; and determining, as the subsequent deactivation interval, an interval closer to the target deactivation interval than the current deactivation interval by X cylinders when the difference between the current deactivation interval and the target deactivation interval exceeds X cylinders. The value of X is a natural number and a variable value that varies in accordance with an operating state of the engine.

A further aspect provides a variable combustion cylinder ratio control device, which is configured to variably control a combustion cylinder ratio of an engine during an intermittent deactivation operation, in which cylinder deactivation is intermittently executed. The variable control device includes processing circuitry. The processing circuitry is configured to set, as a target ratio, a combustion cylinder ratio that is achievable by repeating cylinder deactivation at regular intervals. A cylinder deactivation interval that achieves a current combustion cylinder ratio is defined as a current deactivation interval. A cylinder deactivation interval from execution of the cylinder deactivation at the current deactivation interval to execution of a subsequent cylinder deactivation is defined as a subsequent deactivation interval. A cylinder deactivation interval that achieves the target ratio is defined as a target deactivation interval. The processing circuitry is configured to: determine the target deactivation interval as the subsequent deactivation interval when a difference between the current deactivation interval and the target deactivation interval is less than or equal to X cylinders; and determine, as the subsequent deactivation interval, an interval closer to the target deactivation interval than the current deactivation interval by X cylinders when the difference between the current deactivation interval and the target deactivation interval exceeds X cylinders. The value of X is a natural number and a variable value that varies in accordance with an operating state of the engine.

Other aspects and advantages of the present disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A variable combustion cylinder ratio control device and method according to a first embodiment will now be described with reference to FIGS. 1 to 7.

Figure 1:
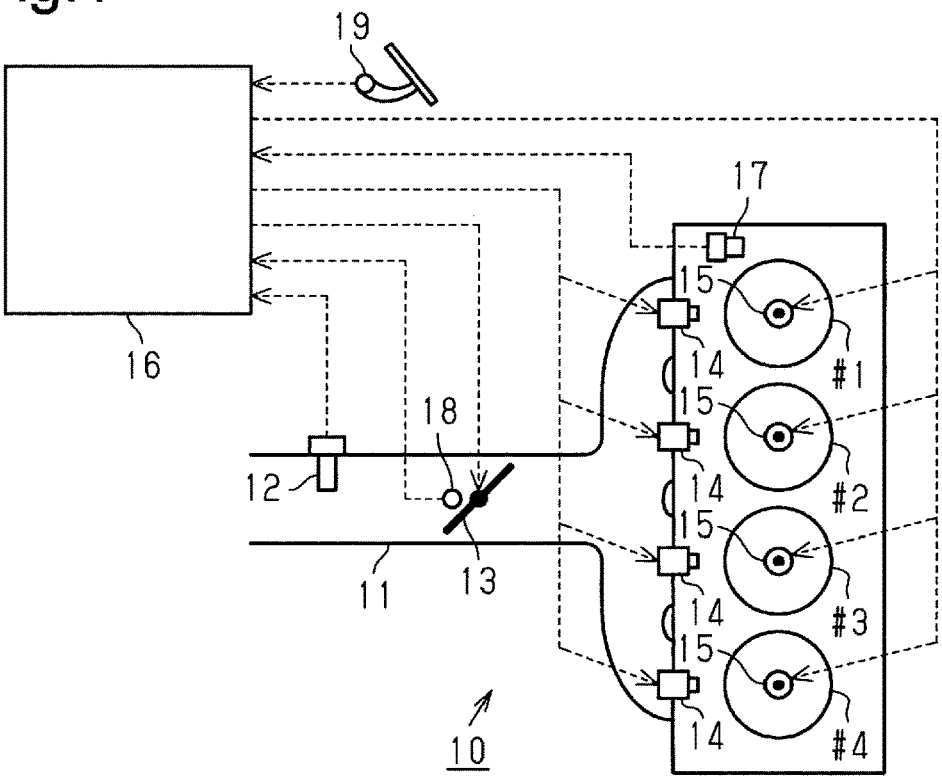
FIG. 1 is a diagram schematically showing the configuration of a variable combustion cylinder ratio control device according to a first embodiment.

FIG. 1 shows the configuration of an engine 10 in which the variable control device of the present embodiment is employed. As shown in FIG. 1, the engine 10 includes four cylinders #1 to #4, which are arranged in-line. In the engine 10, ignition is executed in the order of the cylinder #1, the cylinder #3, the cylinder #4, and the cylinder #2. The engine 10 includes an intake passage 11, in which an air flowmeter 12 and a throttle valve 13 are provided. The air flowmeter 12 detects the flow rate (intake air amount GA) of intake air that flows inside the intake passage 11. The throttle valve 13 is a flow rate control valve configured to adjust the intake air amount GA. Furthermore, the engine 10 includes injectors 14 and ignition plugs 15, which are provided for respective cylinders. The injector 14 injects fuel and the ignition plug 15 generates spark discharge to ignite the fuel.

The variable control device of the present embodiment includes an electronic control unit 16, which is a microcontroller configured to control operation of the engine 10. The electronic control unit 16 receives detection signals of various types of sensors such as the above-described air flowmeter 12, a crank angle sensor 17 configured to detect the crank angle of the engine 10, a throttle opening degree sensor 18 configured to detect the opening degree of the throttle valve 13 (the throttle opening degree TA), and an accelerator pedal sensor 19 configured to detect the depression amount of the accelerator pedal. Based on the detection signals from these sensors, the electronic control unit 16 executes various types of control such as opening degree control of the throttle valve 13, fuel injection control of the injectors 14, ignition timing control of the ignition plugs 15, thereby executing operation control of the engine 10.

The electronic control unit 16 obtains the engine speed NE from the rate of change of the crank angle detected by the crank angle sensor 17. The electronic control unit 16 also obtains the required torque of the engine 10 from the depression amount of the accelerator pedal detected by the accelerator pedal sensor 19 and the engine speed NE.

The electronic control unit 16 is configured to execute variable control of the combustion cylinder ratio as part of the operation control of the engine 10. The combustion cylinder ratio is the ratio of the number of cylinders in which combustion is executed (combustion cylinder) to the sum of the number of the combustion cylinders and the number of cylinders in which combustion is suspended (deactivated cylinders). In the all-cylinder combustion operation, in which combustion is executed in every cylinder entering the combustion stroke, the combustion cylinder ratio is 100% (100%=1). In the intermittent deactivation operation, in which combustion is suspended in some cylinders, the combustion cylinder ratio is a value less than 100%.

In the all-cylinder combustion operation, fuel injection of the injector 14 and discharge of the ignition plug 15 are repeatedly executed at every combustion cycle in all the cylinders #1 to #4. In contrast, in the intermittent deactivation operation, fuel injection of the injector 14 and spark discharge of the ignition plug 15 are repeated at each combustion cycle in any of cylinders while that cylinder is not subjected to combustion deactivation. Then, when the cylinder is subjected to the combustion deactivation, fuel injection of the injector 14 and spark discharge of the ignition plug 15 in the cylinder are stopped for one combustion cycle.

Figure 2:
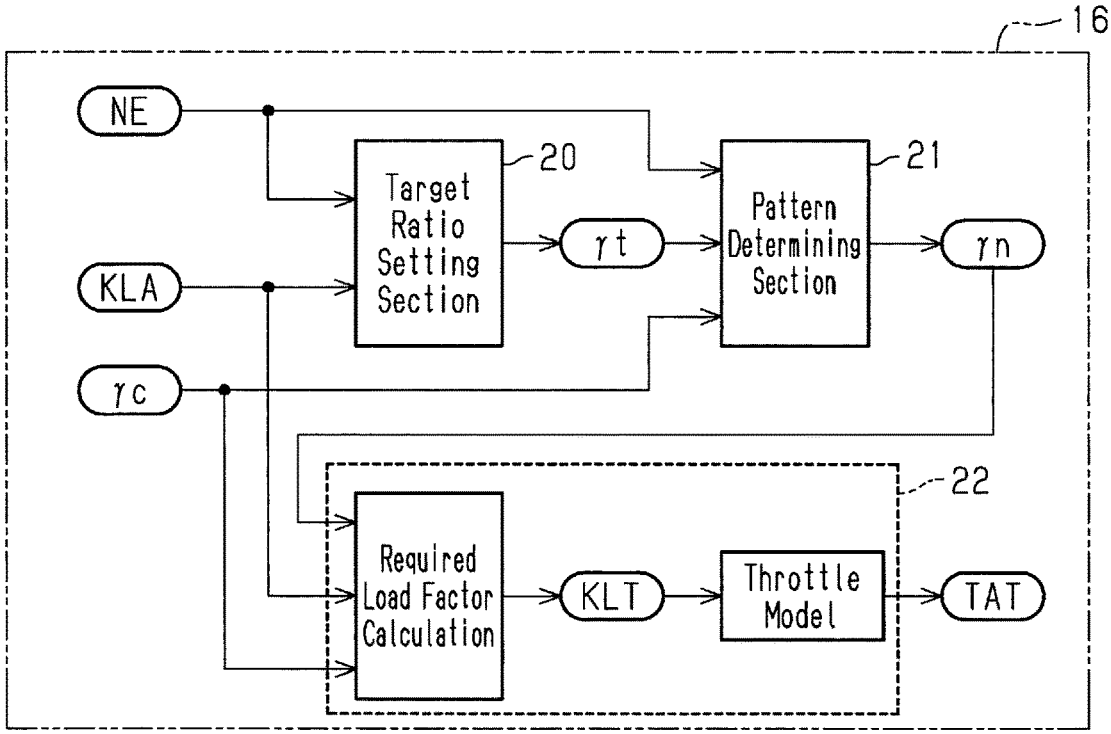
FIG. 2 is a block diagram schematically showing the variable control device, which is used in variable combustion cylinder ratio control.

FIG. 2 shows the configuration of the electronic control unit 16, which executes the variable combustion cylinder ratio control. As shown in FIG. 2, the electronic control unit 16 includes a target ratio setting section 20, a pattern determining section 21, and an air amount adjusting section 22.

The target ratio setting section 20 is configured to calculate a target ratio γT, which is a target value of the combustion cylinder ratio in the variable control in accordance with the operating state of the engine 10. The pattern determining section 21 is configured to determine the cylinder deactivation pattern of the engine 10 based on the calculated target ratio γT. The air amount adjusting section 22 is configured to adjust the engine load factor KL in accordance with changes of the cylinder deactivation pattern, that is, changes of the combustion cylinder ratio. The engine load factor KL represents the ratio of the cylinder inflow air amount to the maximum cylinder inflow air amount. The cylinder inflow air amount is the intake air amount per cycle of one cylinder, and the cylinder inflow air amount when the opening degree of the throttle valve 13 is maximized is the maximum cylinder inflow air amount.

Calculation of Target Ratio

The calculation of the target ratio γt by the target ratio setting section 20 will now be described. At a predetermined control cycle, the target ratio setting section 20 calculates the target ratio γt based on the engine speed and an all-cylinder combustion load factor KLA. The all-cylinder combustion load factor KLA represents the engine load factor KL required to generate the required torque when it is assumed that the engine 10 is executing the all-cylinder combustion operation. The value of the all-cylinder combustion load factor KLA is calculated based on the engine speed NE and the required torque.

Figure 3:
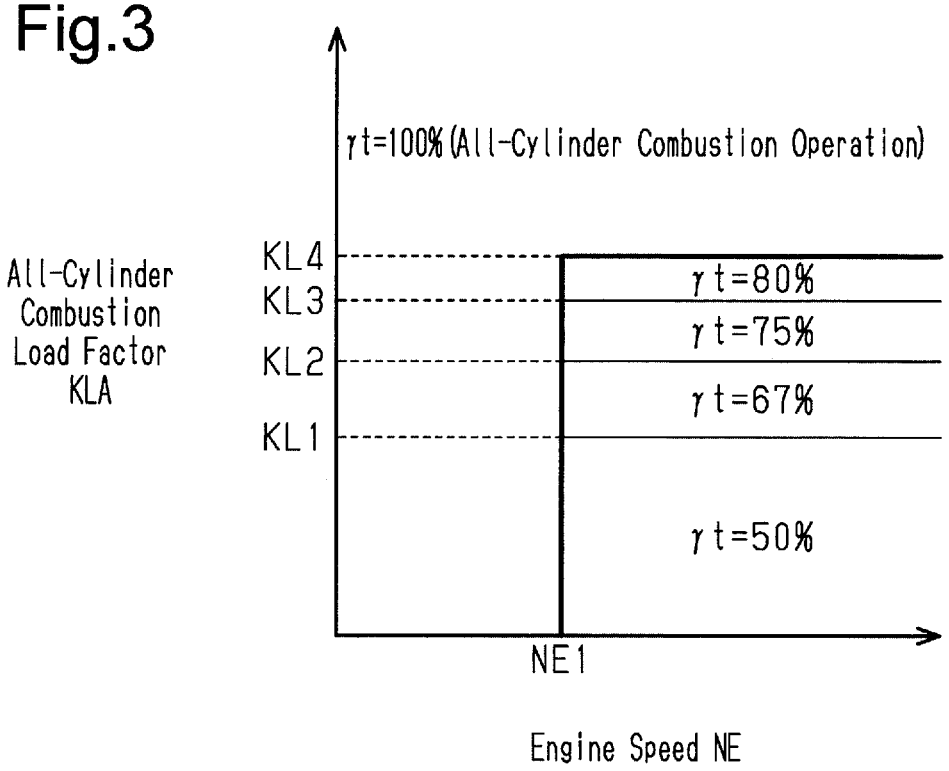
FIG. 3 is a graph showing the relationship of the engine speed with the engine load factor and the target ratio in the variable control device.

FIG. 3 shows a manner in which the target ratio γt is set in the present embodiment. In the present embodiment, the target ratio γt is set to any of the values 50%, 67%, 75%, 80%, and 100%.

As shown in FIG. 3, in the region in which the engine speed NE is less than or equal to a preset value NE1, the value of the target ratio γt is set to 100% irrespective of the all-cylinder combustion load factor KLA. In the region in which the engine speed NE exceeds the preset value NE1, the value of the target ratio γt is variably set in the range from 50% to 100% in accordance with the all-cylinder combustion load factor KLA. Specifically, in the region in which the engine speed NE exceeds the preset value NE1, the target ratio γt is set to 50% when the all-cylinder combustion load factor KLA is less than a preset value KL1, and to 67% when the all-cylinder combustion load factor KLA is greater than or equal to the preset value KL1 and less than a preset value KL2 (KL2>KL1). Furthermore, when the all-cylinder combustion load factor is greater than or equal to the preset value KL2 and less than a preset value KL3 (KL3>KL2), the target ratio γt is set to 75%. When the all-cylinder combustion load factor is greater than or equal to the preset value KL3 and less than a preset value KL4 (KL4>KL3), the target ratio γt is set to 80%. Furthermore, when the all-cylinder combustion load factor is greater than or equal to the preset value KL4, the target ratio γt is set to 100%.

Determination of Cylinder Deactivation Pattern

Next, the determination of the cylinder deactivation pattern by the pattern determining section 21 will be described. In the present embodiment, the variable control of the combustion cylinder ratio employs nine values of the combustion cylinder ratio: 0%, 50%, 67%, 75%, 80%, 83%, 86%, 88%, and 100%. Table 1 shows the order of combustion and deactivation of the cylinders for each of the nine values of the combustion cylinder ratio. The combustion cylinder ratio is 0% at the all-cylinder deactivation, at which all the cylinders are deactivated as in the fuel cutoff operation and at stopping of idle.

TABLE 1

| Combustion | | Deactivation (—)/Combustion (○) | | | | | | | | | | | | | | | | | | | | | | | |
|---|---|---|---|---|---|---|---|---|---|---|---|---|---|---|---|---|---|---|---|---|---|---|---|---|---|
| Cylinder Ratio | ID | #1 | #3 | #4 | #2 | #1 | #3 | #4 | #2 | #1 | #3 | #4 | #2 | #1 | #3 | #4 | #2 | #1 | #3 | #4 | #2 | #1 | #3 | ... |
| 0% | (0) | — | — | — | — | — | — | — | — | — | — | — | — | — | — | — | — | — | — | — | — | — | — | ... |
| 50% | 1 | ○ | — | ○ | — | ○ | — | ○ | — | ○ | — | ○ | — | ○ | — | ○ | — | ○ | — | ○ | — | ○ | — | ... |
| 67% | 2 | ○ | ○ | — | ○ | ○ | — | ○ | ○ | — | ○ | ○ | — | ○ | ○ | — | ○ | ○ | — | ○ | ○ | — | ○ | ... |
| 75% | 3 | ○ | ○ | ○ | — | ○ | ○ | ○ | — | ○ | ○ | ○ | — | ○ | ○ | ○ | — | ○ | ○ | ○ | — | ○ | ○ | ... |
| 80% | 4 | ○ | ○ | ○ | ○ | — | ○ | ○ | ○ | ○ | — | ○ | ○ | ○ | ○ | — | ○ | ○ | ○ | ○ | — | ○ | ○ | ... |
| 83% | 5 | ○ | ○ | ○ | ○ | ○ | — | ○ | ○ | ○ | ○ | ○ | — | ○ | ○ | ○ | ○ | ○ | — | ○ | ○ | ○ | ○ | ... |

TABLE 1-continued

| Combustion | | Deactivation (—)/Combustion (○) | | | | | | | | | | | | | | | | | | | | | | | |
|---|---|---|---|---|---|---|---|---|---|---|---|---|---|---|---|---|---|---|---|---|---|---|---|---|---|
| Cylinder Ratio | ID | #1 | #3 | #4 | #2 | #1 | #3 | #4 | #2 | #1 | #3 | #4 | #2 | #1 | #3 | #4 | #2 | #1 | #3 | #4 | #2 | #1 | #3 | ... |
| 86% | 6 | ○ | ○ | ○ | ○ | ○ | ○ | — | ○ | ○ | ○ | ○ | ○ | ○ | — | ○ | ○ | ○ | ○ | ○ | ○ | — | ○ | ... |
| 88% | 7 | ○ | ○ | ○ | ○ | ○ | ○ | ○ | — | ○ | ○ | ○ | ○ | ○ | ○ | ○ | — | ○ | ○ | ○ | ○ | ○ | ○ | ... |
| 100% | (8) | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ... |

Among the nine combustion cylinder ratios above, 0% is the ratio of the all-cylinder deactivation, and 100% is the ratio of the all-cylinder combustion. Accordingly, among the combustion cylinder ratios shown in Table 1, the ratios used during the intermittent deactivation operation of the engine 10 are seven values: 50%, 67%, 75%, 80%, 83%, 86%, and 88%. With each of these combustion cylinder ratios, the cylinder deactivation is repeatedly executed in a pattern in which combustion is executed consecutively in n cylinders in the order of the cylinders entering the combustion stroke, and then the subsequent cylinder is deactivated. That is, all the combustion cylinder ratios used during the intermittent deactivation operation are achievable by repeating cylinder deactivation in the above pattern, that is, by repeating cylinder deactivation at regular intervals. The combustion cylinder ratios of 50%, 67%, 75%, and 80%, which are calculated as the target ratios γt during the intermittent deactivation operation by the target ratio setting section 20, are also combustion cylinder ratios that are achievable by repeating cylinder deactivation at regular intervals.

As described above, the combustion cylinder ratio in the intermittent deactivation operation will be set to any of 50%, 67%, 75%, 80%, 83%, 86%, or 88%. Each of the ratios can be changed to the next by changing the cylinder deactivation interval by one cylinder at a time. That is, in the present embodiment, when changing the combustion cylinder ratio during the intermittent deactivation operation, the minimum change amount of the cylinder deactivation interval is one cylinder.

In the present embodiment, each of the above-described cylinder deactivation patterns is given an identification number (ID), the value of which is the cylinder deactivation interval of each pattern. Furthermore, in the present embodiment, the case in which the combustion cylinder ratio is 0% (the all-cylinder deactivation) or 100% (the all-cylinder combustion) is treated as follows. That is, in the case of the combustion cylinder ratio of 0% (the all-cylinder deactivation), in which only cylinder deactivation is repeated, the pattern with a single cylinder deactivation is defined as the cylinder deactivation pattern for the purpose of convenience, and the identification number of that pattern is defined as 0. Also, in the case of the combustion cylinder ratio of 100%, in which only combustion is repeated, the pattern with a single combustion is defined as the cylinder deactivation pattern for the purpose of convenience, and the identification number of that pattern is defined as 8.

At every predetermined control period during the operation of the engine 10, the pattern determining section 21 determines the combustion cylinder ratio of the cylinder deactivation pattern to be executed after the currently executed cylinder deactivation pattern (hereinafter, referred to as a subsequent combustion cylinder ratio γn). In the determination, the pattern determining section 21 reads in the currently executed combustion cylinder ratio (hereinafter, referred to as the current combustion cylinder ratio γc), the target ratio γt, and the engine speed NE. Then, the pattern determining section 21 calculates the subsequent combustion cylinder ratio γn by referring to calculation maps that are previously stored in the electronic control unit 16.

When changing the cylinder deactivation pattern, the electronic control unit 16 first completes the cylinder deactivation pattern before the change and starts the cylinder deactivation pattern after the change. That is, the electronic control unit 16 starts the cylinder deactivation pattern corresponding to the subsequent combustion cylinder ratio γn from the beginning after executing the cylinder deactivation pattern corresponding to the current combustion cylinder ratio γc to the end.

Figure 4:
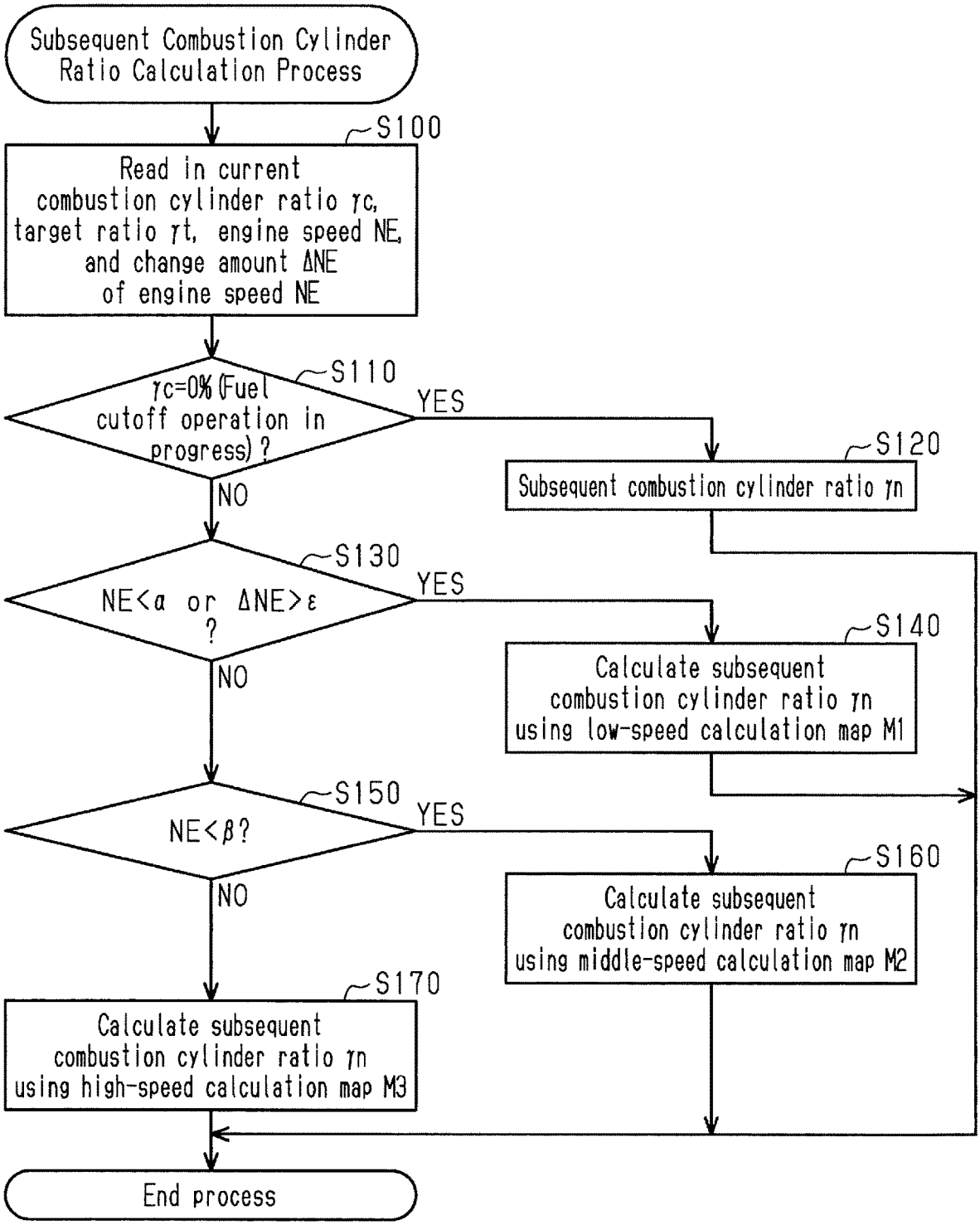
FIG. 4 is a flowchart of a subsequent combustion cylinder ratio determination process executed by the pattern determining section in the variable control device.

FIG. 4 shows the process of the subsequent ratio calculation routine configured to calculate the subsequent combustion cylinder ratio γn. The pattern determining section 21 carries out the process of this routine at each specified calculation cycle during the operation of the engine 10.

When the process of the routine is started, the pattern determining section 21 first reads in the current combustion cylinder ratio γc, the target ratio γt, the engine speed NE, and the change amount ΔNE of the engine speed NE in step S100. The change amount ΔNE represents the amount of change of the engine speed NE in a predetermined time.

Subsequently, the pattern determining section 21 determines whether the current combustion cylinder ratio γc is 0%, that is, whether the fuel cutoff operation is being executed, in step S100. If the current combustion cylinder ratio γc is 0% (S110: YES), the process proceeds to step S120. In step S120, the subsequent combustion cylinder ratio γn is set to the value of the target ratio γt, and the process of the current routine is ended.

If the current combustion cylinder ratio γc is not 0%, the process proceeds to step S130, in which the pattern determining section 21 determines whether at least one of the following conditions is met: the engine speed NE is less than a preset value α, and the change amount ΔNE of the engine speed NE exceeds a preset value ε. If the determination in step S130 is affirmative (YES), the process proceeds to step S140. If the determination is negative (NO), the process proceeds to step S150.

When the process proceeds to step S140, the pattern determining section 21 calculates the subsequent combustion cylinder ratio γn using a low-speed calculation map M1 in step S140. Thereafter, the process of the current routine is ended. In the present embodiment, the electronic control unit 16 stores in advance, as maps used to calculate the subsequent combustion cylinder ratio γn, a middle-speed calculation map M2 and a high-speed calculation map M3, in addition to the low-speed calculation map M1. The specific contents of these calculation maps M1 to M3 and the calculation of the subsequent combustion cylinder ratio γn using these will be discussed below.

When the process proceeds to step S150, the pattern determining section 21 determines whether engine speed NE is less than a preset value β (β>α) in step S150. When the engine speed NE is less than the preset value β (S150: YES), the process proceeds to step S160. The pattern determining section 21 calculates the subsequent combustion cylinder ratio γn using the middle-speed calculation map M2 in the step S160, and then ends the process of the current routine. In contrast, when the engine speed NE is greater than or equal to the preset value β (S150: NO), the process proceeds to step S170. The pattern determining section 21 calculates the subsequent combustion cylinder ratio γn using the high-speed calculation map M3 in the step S170, and then ends the process of the current routine.

Subsequently, the three calculation maps M1 to M3 used in the subsequent ratio computation routine and the manner in which the subsequent combustion cylinder ratio γn is calculated using these maps will now be described. As described above, the low-speed calculation map M1 is used to calculate the subsequent combustion cylinder ratio γn when the fuel cutoff operation is not being executed, and the engine speed NE is less than the preset value α or the change amount ΔNE exceeds the preset value ε. The middle-speed calculation map M2 is used to calculate the subsequent combustion cylinder ratio γn when the fuel cutoff operation is not being executed, and the engine speed NE is greater than or equal to the preset value α and less than than preset value β. The high-speed calculation map M3 is used to calculate the subsequent combustion cylinder ratio γn when the fuel cutoff operation is not being executed, and the engine speed NE is greater than or equal to the preset value β.

These calculation maps M1 to M3 represent the ranges of the combustion cylinder ratio that can be set as the subsequent combustion cylinder ratio γn in relation to the current combustion cylinder ratio γc. The pattern determining section 21 obtains the combustion cylinder ratio that can be set as the subsequent combustion cylinder ratio γn from the current combustion cylinder ratio γc by referring to the corresponding calculation maps M1 to M3 in the process of the above-described steps S140, S160 and S170. Then, the pattern determining section 21 calculates, as the value of the subsequent combustion cylinder ratio γn, the ratio closest to the target ratio γt among the settable cylinder ratios.

Specific settings of the calculation maps M1 to M3 will now be described. Table 2 shows the rate of change Δγ of the combustion cylinder ratio before and after the combustion cylinder ratio is changed among 50%, 67%, 75%, 80%, 83%, 86%, 88%, and 100%. When the combustion cylinder ratio before the change is defined as γ1 and the combustion cylinder ratio after the change is defined as γ2, the rate of change Δγ is a value that satisfies the relationship of the equation (1).

$$\Delta\gamma = \left|\frac{\gamma 2 - \gamma 1}{\gamma 1}\right| \tag{1}$$

The generated torque per unit time of the engine 10 when the intermittent deactivation operation is executed by repeating each cylinder deactivation pattern corresponding to seven combustion cylinder ratios of 50% to 88% used during the intermittent deactivation operation is defined as an average torque during the intermittent deactivation operation. If the torque generated by the combustion of one cylinder is constant, the average torque at the time of the intermittent deactivation operation is the product obtained by multiplying the generated torque per unit time of engine 10 at the time of the all-cylinder combustion by the combustion cylinder ratio. Therefore, if the torque generated by the combustion of one cylinder is constant, the rate of change of the average torque when the combustion cylinder ratio is changed is equal to the rate of change Δγ of the combustion cylinder ratio before and after the change.

When the engine speed NE is lcw, the combustion cycle is long. Accordingly, a change of the engine speed NE in response to a change of the average torque when the combustion cylinder ratio is changed also changes slowly and gradually. Therefore, when the engine speed NE is low, the speed fluctuation of the engine 10 due to a change of the combustion cylinder ratio is unlikely to cause deterioration of the drivability.

Based on the above, the above-described calculation maps M1 to M3 are configured as follows in the present embodiment. Tables 3 to 5 show the relationship between the current combustion cylinder ratio γc in each of the calculation maps M1 to M3 and the combustion cylinder ratio that can be set as the subsequent combustion cylinder ratio γn.

TABLE 2

| | | Combustion Cylinder Ratio after Change | | | | | | | |
|---|---|---|---|---|---|---|---|---|---|
| | | 100% (n = ∞) | 88% (n = 7) | 86% (n = 6) | 83% (n = 5) | 80% (n = 4) | 75% (n = 3) | 67% (n = 2) | 50% (n = 1) |
| Combustion Cylinder Ratio before Change | 100% (n = ∞) | 0.0% | 12.5% | 14.3% | 16.7% | 20.0% | 25.0% | 33.3% | 50.0% |
| | 88% (n = 7) | 14.3% | 0.0% | 2.0% | 4.8% | 8.6% | 14.3% | 23.8% | 42.9% |
| | 86% (n = 6) | 16.7% | 2.1% | 0.0% | 2.8% | 6.7% | 12.5% | 22.2% | 41.7% |
| | 83% (n = 5) | 20.0% | 5.0% | 2.9% | 0.0% | 4.0% | 10.0% | 20.0% | 40.0% |
| | 80% (n = 4) | 25.0% | 9.4% | 7.1% | 4.2% | 0.0% | 6.3% | 16.7% | 37.5% |
| | 75% (n = 3) | 33.3% | 16.7% | 14.3% | 11.1% | 6.7% | 0.0% | 11.1% | 33.3% |
| | 67% (n = 2) | 50.0% | 31.3% | 28.6% | 25.0% | 20.0% | 12.5% | 0.0% | 25.0% |
| | 50% (n = 1) | 100.0% | 75.0% | 71.4% | 66.7% | 60.0% | 50.0% | 33.3% | 0.0% |

TABLE 3

| Low-Speed Calculation Map M1 | | | | | | | | | |
|---|---|---|---|---|---|---|---|---|---|
| | | Subsequent Combustion Cylinder Ratio (○: Settable, —: Not Settable) | | | | | | | |
| | | 100% | 88% | 86% | 83% | 80% | 75% | 67% | 50% |
| Current Combustion Cylinder Ratio | 100% | ○ | ○ | ○ | ○ | ○ | — | — | — |
| | 88% | ○ | ○ | ○ | ○ | ○ | ○ | ○ | — |
| | 86% | ○ | ○ | ○ | ○ | ○ | ○ | ○ | — |
| | 83% | ○ | ○ | ○ | ○ | ○ | ○ | ○ | — |
| | 80% | — | ○ | ○ | ○ | ○ | ○ | ○ | — |
| | 75% | — | ○ | ○ | ○ | ○ | ○ | ○ | — |
| | 67% | — | — | — | — | ○ | ○ | ○ | ○ |
| | 50% | — | — | — | — | — | — | ○ | ○ |

TABLE 4

| Middle-Speed Calculation Map M2 | | | | | | | | | |
|---|---|---|---|---|---|---|---|---|---|
| | | Subsequent Combustion Cylinder Ratio (○: Settable, —: Not Settable) | | | | | | | |
| | | 100% | 88% | 86% | 83% | 80% | 75% | 67% | 50% |
| Current Combustion Cylinder Ratio | 100% | ○ | ○ | ○ | — | — | — | — | — |
| | 88% | ○ | ○ | ○ | ○ | ○ | ○ | — | — |
| | 86% | — | ○ | ○ | ○ | ○ | ○ | — | — |
| | 83% | — | ○ | ○ | ○ | ○ | ○ | — | — |
| | 80% | — | ○ | ○ | ○ | ○ | ○ | — | — |
| | 75% | — | — | ○ | ○ | ○ | ○ | ○ | — |
| | 67% | — | — | — | — | — | ○ | ○ | ○ |
| | 50% | — | — | — | — | — | — | ○ | ○ |

TABLE 5

| High-Speed Calculation Map M3 | | | | | | | | | |
|---|---|---|---|---|---|---|---|---|---|
| | | Subsequent Combustion Cylinder Ratio (○: Settable, —: Not Settable) | | | | | | | |
| | | 100% | 88% | 86% | 83% | 80% | 75% | 67% | 50% |
| Current Combustion Cylinder Ratio | 100% | ○ | ○ | — | — | — | — | — | — |
| | 88% | ○ | ○ | ○ | — | — | — | — | — |
| | 86% | — | ○ | ○ | ○ | — | — | — | — |
| | 83% | — | — | ○ | ○ | ○ | — | — | — |
| | 80% | — | — | — | ○ | ○ | ○ | — | — |
| | 75% | — | — | — | — | ○ | ○ | ○ | — |
| | 67% | — | — | — | — | — | ○ | ○ | ○ |
| | 50% | — | — | — | — | — | — | ○ | ○ |

In the low-speed calculation map M1, ratios in which the rate of change Δγ of the combustion cylinder ratio before and after the combustion cylinder ratio is changed from the current combustion cylinder ratio γc to the subsequent combustion cylinder ratio γn is less than 25% can be set as the subsequent combustion cylinder ratio γn. In contrast, in the middle-speed calculation map M2, ratios in which the rate of change Δγ of the combustion cylinder ratio before and after the combustion cylinder ratio is changed from the current combustion cylinder ratio γc to the subsequent combustion cylinder ratio γn is less than 15% can be set as the subsequent combustion cylinder ratio γn. That is, in these calculation maps M1 and M2, the ratios in which the rate of change Δγ is less than a preset limit value MX are combustion cylinder ratios that can be set as the subsequent combustion cylinder ratio γn.

Depending on the value of the current combustion cylinder ratio γc, the combustion cylinder ratios in which the rate of change Δγ is less than the limit value MX may only include a ratio equal to the current combustion cylinder ratio γc (for example, when γc=50%). Even in such a case, the calculation maps M1, M2 allow the combustion cylinder ratio to be changed. Specifically, irrespective of the value of the current combustion cylinder ratios γc, a combustion cylinder ratio of which the difference in the value of the identification number of the corresponding cylinder deactivation pattern is less than or equal to one can be set as the subsequent combustion cylinder ratio γn.

In the low and middle-speed calculation maps M1 and M2, among the eight combustion cylinder ratios, which can be set during the all-cylinder combustion operation or the intermittent deactivation operation, a combustion cylinder ratio that satisfies at least one of the following requirements (A) and (B) can be set as the subsequent combustion cylinder ratio γn.

(A) The rate of change Δγ of the combustion cylinder ratio in relation to the current combustion cylinder ratio γc is less than the preset limit value MX.

(B) The difference of the identification number of the corresponding cylinder deactivation pattern from that of the current combustion cylinder ratio γc is less than or equal to one.

As far as the intermittent deactivation operation, which changes the combustion cylinder ratio by changing the cylinder deactivation interval, is concerned, a combustion cylinder ratio that satisfies the requirement (B) is achievable by changing the cylinder deactivation interval of the current combustion cylinder ratio γc by one or less cylinder. As described above, when changing the combustion cylinder ratio during the intermittent deactivation operation, the minimum change amount of the cylinder deactivation interval is equivalent to one cylinder. Therefore, a combustion cylinder ratio that satisfies the requirement (B) is a ratio in which the difference in the cylinder deactivation interval from the current combustion cylinder ratio γc is within the minimum change amount of the cylinder deactivation interval.

As shown in Table 5, in the high-speed calculation map M3, only the ratios in which the difference in the value of the identification number of the corresponding cylinder deactivation pattern is one or less from the current combustion cylinder ratio γc can be set as the subsequent combustion cylinder ratio γn. The high-speed calculation map M3 is also regarded as a calculation map in which the combustion cylinder ratio that satisfies at least one of the above requirements (A) and (B) when the limit value MX is 0% can be set as the subsequent combustion cylinder ratio γn.

Adjustment of Engine Load Factor

Adjustment of a required load factor KLT executed by the air amount adjusting section 22 will now be described. The air amount adjusting section 22 calculates the required load factor KLT so as to satisfy the relationship of the expression (2) with the all-cylinder combustion load factor KLA and the combustion cylinder ratio γ.

$$KLT = \frac{(KLA - KL0)}{\gamma} + KL0 \tag{2}$$

The generated torque per unit time of the engine 10 when the all-cylinder combustion operation is executed with the all-cylinder combustion load factor KLA set to the engine load factor KL is defined as the average torque during the all-cylinder combustion. Also, the value of the engine load factor KL with which the output torque of the engine 10 becomes zero is defined as a zero torque load factor KL0. Furthermore, the generated torque per unit time of the engine 10 when the intermittent deactivation operation is executed by repeating each cylinder deactivation pattern corresponding to the combustion cylinder ratios of 50% to 88% is defined as the average torque during the intermittent deactivation operation. The expression (2) is used to calculate, as the value of the required load factor KLT, the engine load factor KL with which the average torque of the subsequently executed cylinder deactivation pattern will be equalized to the average torque during the all-cylinder combustion.

The air amount adjusting section 22 uses a throttle model, which is a physical model of the behavior of the intake air passing through the throttle valve 13, to calculate a target throttle opening degree TAT, which is the target value of the throttle opening degree TA necessary to set the engine load factor KL to the required load factor KLT.

The electronic control unit 16 controls the throttle valve 13 such that the throttle opening degree TA is equalized to the target throttle opening degree TAT. This adjusts the engine load factor KL so as to suppress changes of the average torque due to changes of the combustion cylinder ratio.

When the intake stroke in the last combustion cylinder in the cylinder deactivation pattern in progress ends, the air amount adjusting section 22 switches the value of the combustion cylinder ratio γ used for calculation of the required load factor KLT from the current combustion cylinder ratio γc to the subsequent combustion cylinder ratio γn. From that point in time, the throttle opening degree TA starts being changed to change the engine load factor KL from the required load factor KLT corresponding to the current combustion cylinder ratio γc to the required load factor KLT corresponding to the subsequent combustion cylinder ratio γn.

The amount of adjustment of the engine load factor KL (hereinafter, referred to as a required adjustment amount ΔKL) necessary to change the combustion cylinder ratio from the current combustion cylinder ratio γc to the subsequent combustion cylinder ratio γn increases as the rate of change Δγ of the combustion cylinder ratio increases. If such adjustment of the engine load factor KL by the required adjustment amount ΔKL is completed before the start of the intake stroke in the first combustion cylinder in the cylinder deactivation pattern after switching, the average torque remains the same before and after changing the combustion cylinder ratio. Therefore, the adjustment of the engine load factor KL is preferably completed in a period from the point in time of the end of the intake stroke in the last combustion cylinder in the cylinder deactivation pattern before switching to the point in time of the start of the intake stroke in the first combustion cylinder in the cylinder deactivation pattern after switching (hereinafter, referred to as a load factor adjustment period).

Due to the operation of the throttle valve 13 and the delay in the conveyance of the intake air from the throttle valve 13 to the cylinders #1 to #4, there is a limit to the amount of change of the engine load factor KL that can be achieved within a certain period of time. In contrast, the load factor adjustment period becomes longer as the engine speed NE is decreased.

Therefore, the lower the engine speed NE, the greater becomes the rate of change Δγ of the combustion cylinder ratio that allows adjustment of the engine load factor KL by the required load factor adjustment amount ΔKL to be completed within the load factor adjustment period. Reflecting this factor, in the calculation maps M1 to M3, the limit value MX of the rate of change Δγ of the combustion cylinder ratio that can be set as the subsequent combustion cylinder ratio γn increases in the order of the high-speed calculation map M3, the middle-speed calculation map M2, and the low-speed calculation map M1.

Operational Advantages of First Embodiment

In the variable combustion cylinder ratio control device of the present embodiment configured as described above, the target ratio setting section 20 sets the target ratio γt in accordance with the operating state of the engine 10 (the engine speed NE, the engine load factor KL). The value of the target ratio γt, which is set by the target ratio setting section 20 at the intermittent deactivation operation, is a combustion cylinder ratio achievable by repeating cylinder deactivation at regular intervals.

Also, in the present embodiment, the pattern determining section 21 determines the subsequent combustion cylinder ratio γn in accordance with the target ratio γt. The subsequent combustion cylinder ratio γn represents the combustion cylinder ratio of the cylinder deactivation pattern to be executed subsequent to the currently executed cylinder deactivation pattern. Any value of the subsequent combustion cylinder ratio γn, which is set by the pattern determining section 21 during the intermittent deactivation operation, is a combustion cylinder ratio achievable by repeating cylinder deactivation at regular intervals, that is, by repeating the cylinder deactivation in a pattern in which combustion is executed consecutively in N cylinders and then one cylinder is deactivated.

The electronic control unit 16 controls the operation of the engine 10 so as to start the cylinder deactivation pattern corresponding to the subsequent combustion cylinder ratio γn after completion of the currently executed cylinder deactivation pattern. Thus, the intermittent deactivation operation is carried out in the engine 10 by repeating the cylinder deactivation in a pattern in which combustion is executed consecutively in N cylinders and then one cylinder is deactivated. A change of the combustion cylinder ratio during such an intermittent deactivation operation is achieved by changing the cylinder deactivation intervals.

In the present embodiment, the subsequent combustion cylinder ratio γn uniquely determines the cylinder deactivation interval between the cylinder deactivation at the interval achieving the current combustion cylinder ratio γc and the execution of the subsequent cylinder deactivation. In the following description, the cylinder deactivation interval that achieves the current combustion cylinder ratio γc will be referred to as a current deactivation interval Nc, and the cylinder deactivation interval from the cylinder deactivation at the current deactivation interval Nc to the execution of the subsequent cylinder deactivation will be referred to as a subsequent deactivation interval Nn. Also, the cylinder deactivation interval that achieves the target ratio γt will be referred to as a target deactivation interval Nt.

The calculation maps M1 to M3 of the above-described subsequent combustion cylinder ratio γn define the range of the combustion cylinder ratio that can be set as the subsequent combustion cylinder ratio γn in relation to the current combustion cylinder ratio γc. That is, the calculation maps M1 to M3 define the range of the cylinder deactivation interval that can be set as the subsequent deactivation interval Nn in relation to the current deactivation interval Nc.

It is now assumed that the range of the cylinder deactivation interval that can be set as the subsequent deactivation interval Nn is within the range of X cylinders in the target deactivation interval Nt in relation to the current deactivation interval Nc. If the value of X at this time is 0, the combustion cylinder ratio cannot be changed at all. Therefore, the value of X is an integer that is greater than or equal to one, that is, a natural number. In determining the subsequent combustion cylinder ratio γn, the calculation maps M1 to M3 to be used are switched depending on the engine speed NE and the amount of change of the engine speed NE per unit time. By referring to the calculation maps M1 to M3 with the current combustion cylinder ratio γc as an argument, the range of the cylinder deactivation interval that can be set as the subsequent deactivation interval Nn is obtained. Thus, X is a natural number and a variable value that varies in accordance with the operating state of the engine 10 such as the current combustion cylinder ratio γc (the current deactivation interval Nc) and the engine speed NE.

Then, if the target ratio γt is within the range of the settable combustion cylinder ratio, the pattern determining section 21 determines the target ratio γt as the subsequent combustion cylinder ratio γn. If the target ratio γt does not exist in that range, the pattern determining section 21 determines the ratio closest to the target ratio γt within that range to be the subsequent combustion cylinder ratio γn. In a case in which the range of the cylinder deactivation interval that can be set as the subsequent deactivation interval Nn is within the range of X cylinders from the current deactivation interval Nc, the target ratio γt exists within the range of the settable combustion cylinder ratio if the difference ΔN between the current deactivation interval Nc and the target deactivation interval Nt is less than or equal to X cylinders. Therefore, when the difference ΔN between the current deactivation interval Nc and the target deactivation interval Nt is less than or equal to X cylinders, the pattern determining section 21 determines the target determination interval Nt as the subsequent deactivation interval Nn. When the difference ΔN exceeds X cylinders, the pattern determining section 21 determines, as the subsequent deactivation interval Nn, an interval closer to the target deactivation interval Nt than the current deactivation interval Nc by X cylinders.

When determining the subsequent combustion cylinder ratio γn, the pattern determining section 21 uses the low-speed calculation map M1 if the engine speed NE is less than the preset value α or when the change amount ΔNE of the engine speed NE is greater than the preset value ε. When the change amount ΔNE of the engine speed NE is less than or equal to the preset value ε and the engine speed NE is greater than or equal to α, the pattern determining section 21 uses the middle-speed calculation map M2 and the high-speed calculation map M3. In the low-speed calculation map M1, the range of the combustion cylinder ratio that can be set as the subsequent combustion cylinder ratio γn is wider than that in the middle-speed calculation map M2. Furthermore, the range is wider in the calculation map M2 than in the high-speed calculation map M3. Therefore, the value of X when the range of the cylinder deactivation interval that can be set as the subsequent deactivation interval Nn is within the range of X cylinders from the current deactivation interval Nc is greater when the engine speed NE is low or the change of the engine speed NE is great than that when the engine speed NE is high or the change of the engine speed NE is small.

In addition, the low-speed calculation map M1 and the middle-speed calculation map M2 are set such that the greater the current combustion cylinder ratio γc, the wider becomes the range of the combustion cylinder ratio that can be set as the subsequent combustion cylinder ratio γn. That is, in the present embodiment, in the low-speed region and the middle-speed region, the value of X when the range of the cylinder deactivation interval that can be set as the subsequent deactivation interval Nn is set to a range within X cylinders from the current deactivation interval Nc is greater when the current deactivation interval Nc is great than that when the current deactivation interval Nc is small.

As described above, in each of the calculation maps M1 to M3, a ratio that satisfies at least one of the requirements (A) and (B) is a combustion cylinder ratio that can be set as the subsequent combustion cylinder ratio γn. That is, the ratio satisfies at least one of the requirement (A) the rate of change Δγ of the combustion cylinder ratio in relation to the current combustion cylinder ratio γc is less than the preset limit value MX, and the requirement (B) the difference of the identification number of the corresponding cylinder deactivation pattern from that of the current combustion cylinder ratio γc is less than or equal to one.

As described above, solely during the intermittent deactivation operation, the combustion cylinder ratio that satisfies the requirement (B) can be achieved by changing the cylinder deactivation interval by the minimum amount (one cylinder) in relation to the current combustion cylinder ratio γc. That is, the combustion cylinder ratio that satisfies the requirement (B) is the ratio in which the value of X when the range of the cylinder deactivation interval that can be set as the subsequent deactivation interval Nn is within the range of X cylinders from the current deactivation interval Nc is the minimum change amount of the cylinder deactivation interval.

In contrast, the combustion cylinder ratio that satisfies the requirement (A) is the combustion cylinder ratio in which the rate of change Δγ of the combustion cylinder ratio when the cylinder deactivation interval is changed from the current deactivation interval Nc to the subsequent deactivation interval Nn is less than the limit value MX. Therefore, the range of the combustion cylinder ratio that satisfies at least one of the above requirements (A) and (B) is the range of the combustion cylinder ratio in which the value X is the greater one of the value at which the rate of change Δγ of the combustion cylinder ratio when the interval of the cylinder deactivation is changed from the current deactivation interval Nc to the subsequent deactivation interval Nn is less than the limit value MX and the minimum change amount of the interval of the cylinder deactivation.

Then, the low-speed calculation map M1 sets the limit value MX to 25%, the medium-speed calculation map M2 sets the limit value MX to 15%, and the high-speed calculation map M3 sets the limit value MX to 0%. That is, when the engine speed NE is low, the pattern determining section 21 assumes that the limit value MX is greater than that when the engine speed is high and accordingly determines the subsequent combustion cylinder ratio γn, that is, the subsequent deactivation interval Nn. Also, when the change of the engine speed NE is great, the pattern determining section 21 assumes that the limit value MX is greater than that when the change of the engine speed is small, and determines the subsequent deactivation interval Nn.

When the current combustion cylinder ratio γc is 100%, that is, during the all-cylinder combustion operation, the range of the combustion cylinder ratio that can be set as the subsequent combustion cylinder ratio γn is the range of 80% to 100% in the low-speed calculation map M1. In the present embodiment, the ratio set as the target ratio γt during the intermittent deactivation operation is 80% or less as shown in FIG. 3. Therefore, when switching from the all-cylinder combustion operation to the intermittent deactivation operation, the intermittent deactivation operation is started with the combustion cylinder ratio set to 80% in the situation in which the low-speed calculation map M1 is used to determine the subsequent combustion cylinder ratio γn. In contrast, the range is from 86% to 100% in the medium-speed calculation map M2, and the range is from 88% to 100% in the high-speed calculation map M3. Therefore, in the situation in which the medium-speed calculation map M2 is used, the intermittent deactivation operation is started with the combustion cylinder ratio set to 86%. In the situation in which the high-speed calculation map M3 is used, the intermittent deactivation operation is started with the combustion cylinder ratio set to 88%.

As described above, the combustion cylinder ratios of 80%, 86% and 88% are achieved by repeating cylinder deactivation with the cylinder deactivation interval set to four cylinders, six cylinders, and seven cylinders, respectively. Therefore, the cylinder deactivation interval when executing the first cylinder deactivation after switching from the all-cylinder combustion operation to the intermittent deactivation operation is four cylinders in a situation in which the low-speed calculation map M1 is used, six cylinders in a situation in which the middle-speed calculation map M2 is used, and seven cylinders in a situation in which the high-speed calculation map M3 is used.

In the low-speed calculation map M1, the combustion cylinder ratio of 100% can be set as the subsequent combustion cylinder ratio γn when the current combustion cylinder ratio is 83% or greater. In the middle and high-speed calculation maps M2, M3, the combustion cylinder ratio of 100% can be set as the subsequent combustion cylinder ratio γn when the current combustion cylinder ratio is 88% or greater. Therefore, in the situation in which the low-speed calculation map M1 is used, it is possible to immediately switch to the all-cylinder combustion operation from the state in which the combustion cylinder ratio is 83%, that is, the state in which the intermittent deactivation operation is being executed with the cylinder deactivation interval set to five cylinders. In the situation in which the medium or high-speed calculation map M2, M3 is used, it is possible to switch to the all-cylinder combustion operation only from the state in which the combustion cylinder ratio is 88%, that is, the state in which the intermittent deactivation operation is being executed with the cylinder deactivation interval set to seen cylinders.

The cylinder deactivation interval when executing the first cylinder deactivation after switching from the all-cylinder combustion operation to the intermittent deactivation operation will be referred to as a starting deactivation interval of the intermittent deactivation operation. Also, the cylinder deactivation interval when executing the last cylinder deactivation before switching from the intermittent deactivation operation to the all-cylinder combustion operation will be referred to as an ending deactivation interval of the intermittent deactivation operation. As described above, in the present embodiment, the starting deactivation interval and the ending deactivation interval are set to be smaller when the engine speed NE is low than when the engine speed NE is high. Also, when the change amount ΔNE of the engine speed NE is great, the starting deactivation interval and the ending deactivation interval of the intermittent deactivation operation are set to be smaller than when the change amount ΔNE is small.

A specific example of an operation related to the variable control of the combustion cylinder ratio according to the present embodiment will now be described. The control of the present embodiment will be described in which the combustion cylinder ratio is changed from 100% to 50%, that is, when the target ratio γt is set to 50% during the all-cylinder combustion operation in each of the low-speed region, the middle-speed region, and the high-speed region. The low-speed region refers to an operation region of the engine 10 in which the low-speed calculation map M1 is used to calculate of the subsequent combustion cylinder ratio γn. The middle-speed region refers to an operation region of the engine 10 in which the middle-speed calculation map M2 is used for the calculation, and the high-speed region refers to an operation region of the engine 10 in which the high-speed calculation map M3 is used for the calculation.

As shown in Table 3, the combustion cylinder ratios that can be set as the subsequent combustion cylinder ratio γn when the current combustion cylinder ratio γc is 100% in the low-speed calculation map M1 are 80%, 83%, 86%, 88%, and 100%. Among these, the ratio closest to 50% of the target ratio γt is 80%. In the calculation map M1, the combustion cylinder ratios that can be set as the subsequent combustion cylinder ratio γn when the current combustion cylinder ratio γc is 80% are 67%, 75%, 80%, 83%, 86%, and 88%. Among these, the ratio closest to 50% is 67%. Furthermore, the combustion cylinder ratios that can be set as the subsequent combustion cylinder ratio γn when the current combustion cylinder ratio γc is 67% in the calculation map M1 are 50%, 67%, 75%, and 80%, including 50%, which is the target ratio γt. Therefore, in the low-speed region, the combustion cylinder ratio is changed from 100% to 50% through three stages of changes in the order of 100%, 80%, 67% and 50%.

Likewise, according to the medium-speed calculation map M2 shown in Table 4, in the middle-speed region, the combustion cylinder ratio is changed from 100% to 50% through four stages of changes in the order of 100%, 86%, 75%, 67% and 50%. Also, according to the high-speed calculation map M3 shown in Table 5, in the high-speed region, the combustion cylinder ratio is changed from 100% to 50% through seven stages of changes in the order of 100%, 88%, 86%, 83%, 80%, 75%, 67% and 50%.

Figure 5:
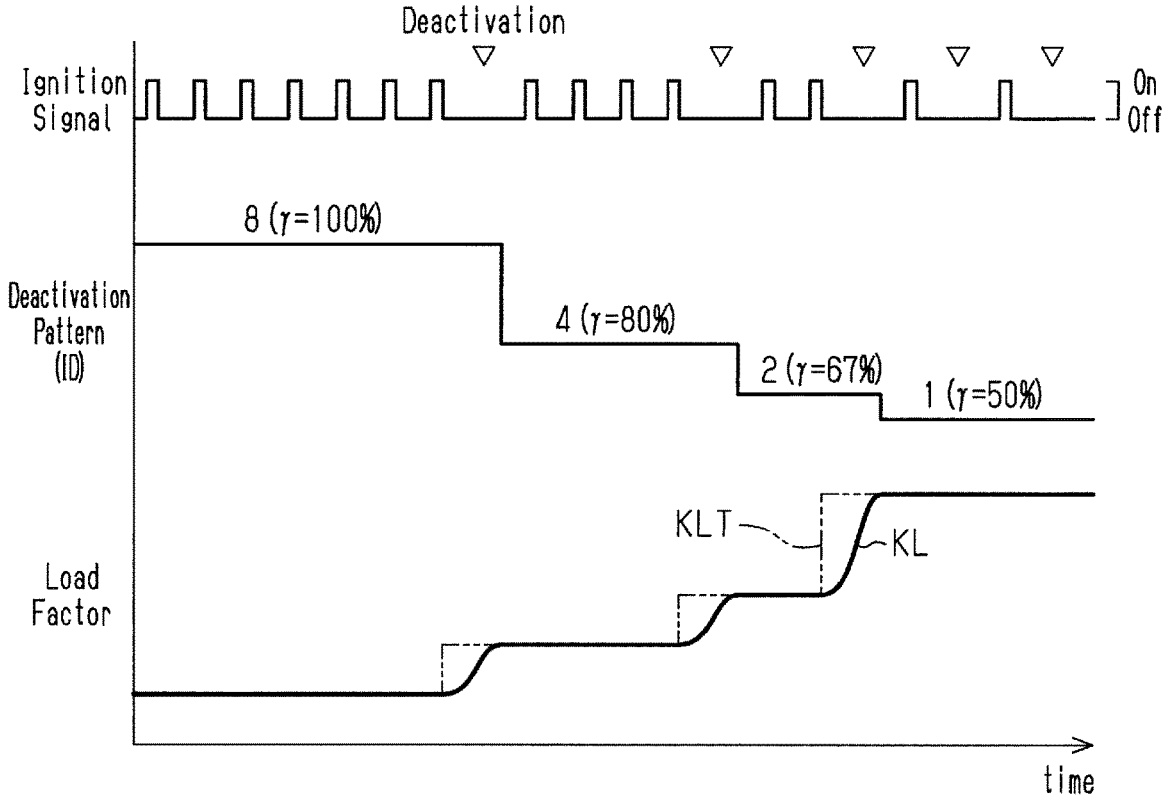
FIG. 5 is a timing diagram showing one example of a manner in which the combustion cylinder ratio is changed in a low-speed region in the variable control device.
Figure 6:
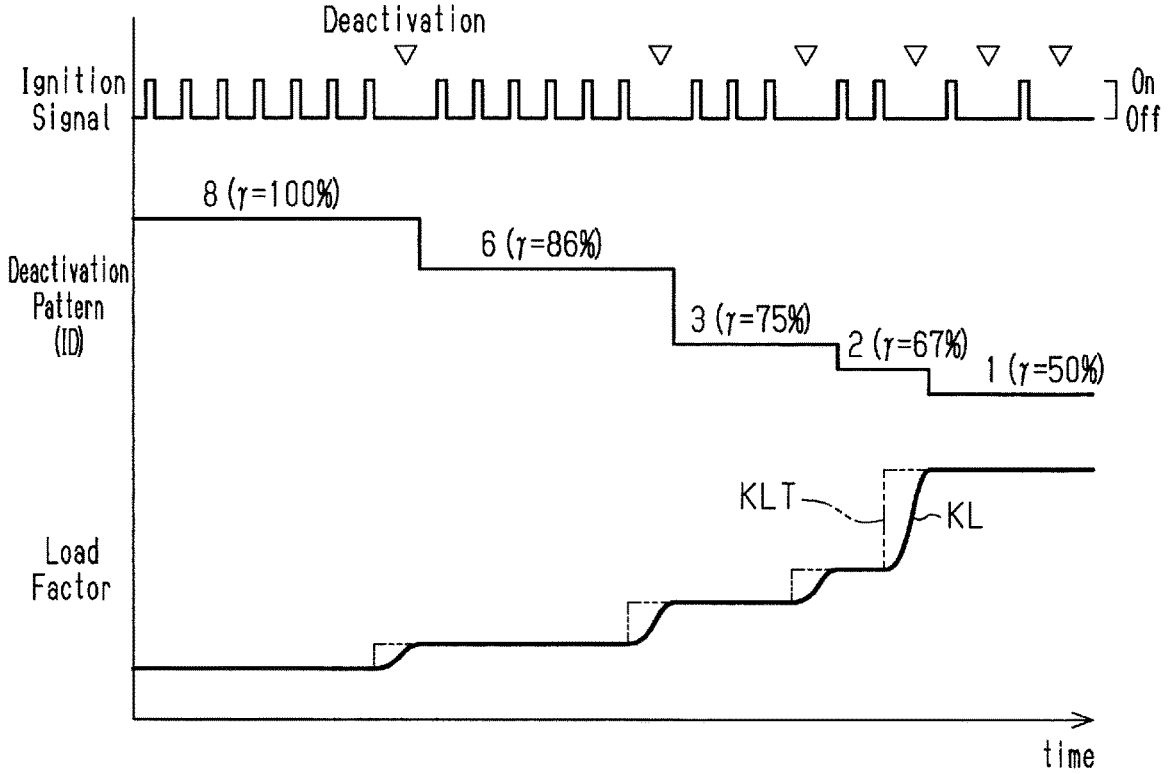
FIG. 6 is a timing diagram showing one example of a manner in which the combustion cylinder ratio is changed in a middle-speed region in the variable control device.
Figure 7:
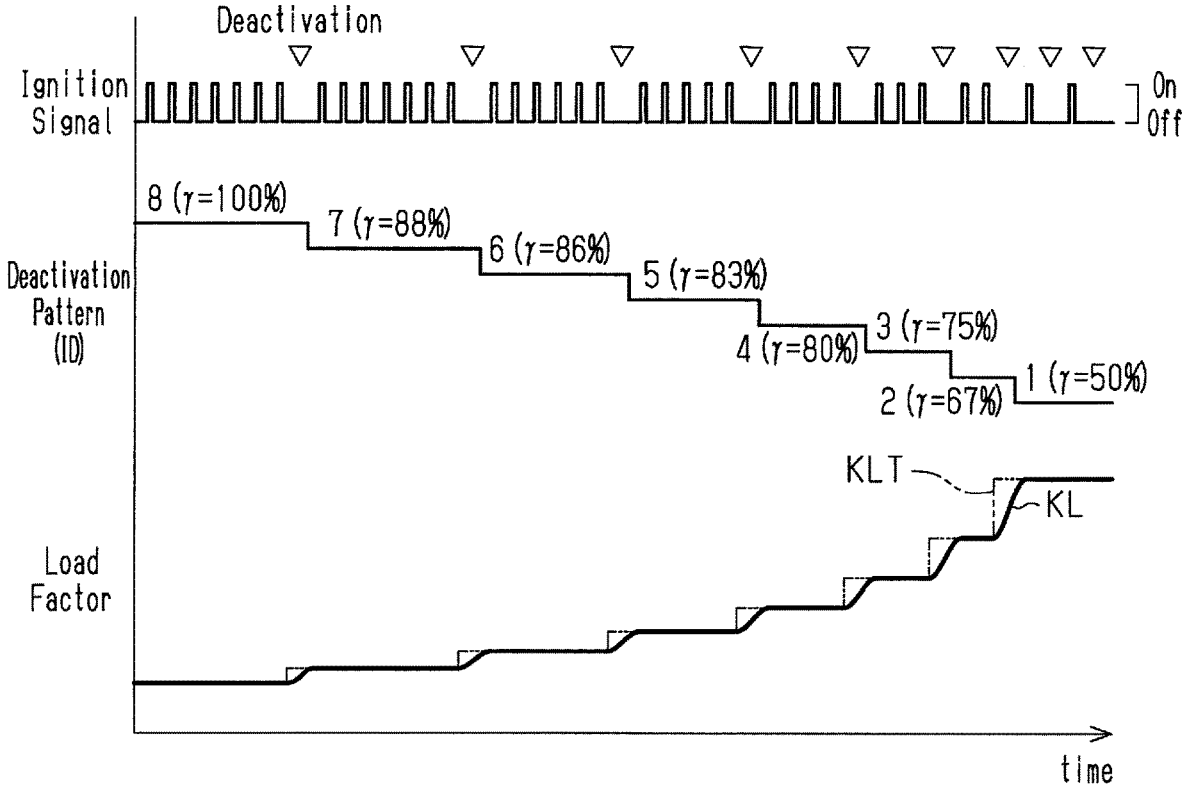
FIG. 7 is a timing diagram showing one example of a manner in which the combustion cylinder ratio is changed in a high-speed region in the variable control device.

FIGS. 5 to 7 show movements of the ignition signal, the cylinder deactivation pattern, the engine load factor KL, and the required load factor KLT when the combustion cylinder ratio is changed from 100% to 50% in each of the low-speed region, the middle-speed region, and the high-speed region.

The ignition signal shown in FIGS. 5 to 7 actually has a composite waveform of the ignition signals individually output to the ignition plugs 15 of the respective cylinders #1 to #4. The ignition signal of the ignition plug 15 of each cylinder is turned on from the energization starting time of the primary coil (not shown) of the ignition coil until the energization stopping time, and the ignition plug 15 is configured to generate a spark discharge simultaneously with the stop of energization of the primary coil, thereby executing ignition. When executing the cylinder deactivation, the ON output of the ignition signal to the ignition plug 15 of the corresponding cylinder is skipped for one combustion cycle, so that the ON cycle of the composite waveform of the signal becomes longer than before and after. To illustrate the cylinder deactivation timing and cylinder deactivation interval, the composite waveform of such ignition signals is shown.

As shown in FIG. 5, in the low-speed region, the cylinder deactivation pattern is switched from the pattern with identification number 8, which corresponds to the combustion cylinder ratio of 100%, to the pattern with identification number 4, which corresponds the combustion cylinder ratio of 80%. At this time, the cylinder deactivation interval n when executing the first cylinder deactivation after switching from the all-cylinder combustion operation to the intermittent deactivation operation is equivalent to four cylinders. Thereafter, the cylinder deactivation pattern is switched to the pattern with identification number 1, which corresponds to the combustion cylinder ratio of 50%, or the target ratio γt, via the pattern with identification number 2, which corresponds to the combustion cylinder ratio of 67%. Accordingly, the cylinder deactivation interval is changed in the order of four cylinders, two cylinders, and one cylinder.

As shown in FIG. 6, in the middle-speed region, the cylinder deactivation pattern is switched from the pattern with identification number 8, which corresponds to the combustion cylinder ratio of 100%, to the pattern with identification number 6, which corresponds the combustion cylinder ratio of 86%. At this time, the cylinder deactivation interval n when executing the first cylinder deactivation after switching from the all-cylinder combustion operation to the intermittent deactivation operation is equivalent to six cylinders. Thereafter, the cylinder deactivation pattern is switched to the pattern with identification number 1, which corresponds to the combustion cylinder ratio of 50%, or the target ratio γt, via the pattern with identification number 3, which corresponds to the combustion cylinder ratio of 75%, and the pattern with identification number 2, which corresponds to the combustion cylinder ratio of 67%. Accordingly, the cylinder deactivation interval is changed in the order of six cylinders, three cylinders, two cylinders, and one cylinder.

As shown in FIG. 7, in the high-speed region, the cylinder deactivation pattern is switched from the pattern with identification number 8, which corresponds to the combustion cylinder ratio of 100%, to the pattern with identification number 7, which corresponds the combustion cylinder ratio of 88%. At this time, the cylinder deactivation interval n when executing the first cylinder deactivation after switching from the all-cylinder combustion operation to the intermittent deactivation operation is equivalent to seven cylinders. Thereafter, by switching to a pattern whose identification number is smaller by one at a time, the cylinder deactivation pattern is switched to the pattern with identification number 1, which corresponds the combustion cylinder ratio of 50%, or the target ratio γt. Accordingly, the cylinder deactivation interval is changed in the order of seven cylinders, six cylinders, five cylinders, four cylinders, three cylinders, two cylinders, and one cylinder.

As described above, in comparison with the cases of the middle and high-speed regions, the number of times the cylinder deactivation pattern is switched is small in the case of the low-speed region when the combustion cylinder ratio is changed from 100% to 50%. Accordingly, the amount of change of the required load factor KLT per switching of patterns, that is, the required adjustment amount ΔKL of the engine load factor KL is increased. However, in the case of the low-speed region, the load factor adjustment period is longer than in the middle and high-speed regions. Thus, even if the required adjustment amount ΔKL is great, it is possible to complete adjustment of the engine load factor KL within the load factor adjustment period.

In contrast, in the case of the high-speed region, the load factor adjustment period is short. However, the required adjustment amount ΔKL per switching of patterns decreases since the number of times the cylinder deactivation pattern is switched when changing the combustion cylinder ratio from 100% to 50% is increased. Therefore, even when the load factor adjustment period is short, adjustment of the engine load factor KL can be completed in the period.

Also, the combustion cycle is relatively long in the low-speed region. Thus, an increase in the number of times of switching of the cylinder deactivation pattern will significantly extend the time required to change the combustion cylinder ratio to the target ratio γt. In contrast, the combustion cycle is relatively short in the high-speed region. Thus, even if the number of times of changing the cylinder deactivation pattern is increased, the combustion cylinder ratio can be changed to the target ratio γt in a relatively short time.

As described above, in the present embodiment, when the target ratio γt is changed significantly, the cylinder deactivation interval is gradually changed in a plurality of times such that the combustion cylinder ratio is changed from the target ratio γt before the change to the target ratio γt after the change. When the engine speed NE is low or when the change of the engine speed NE is great, the number of times of changes of the cylinder deactivation interval up to the target ratio γt after the changes is reduced. This suppresses the engine speed fluctuation due to a change of the cylinder deactivation interval when variably controlling the combustion cylinder ratio, while suppressing deterioration of responsiveness of the variable control.

The engine 10 executes a fuel cutoff operation to deactivate all the cylinders when the vehicle is coasting. The recovery (combustion restart) from the fuel cutoff operation is carried out when the engine speed NE drops to or below a preset recovery speed or when the accelerator pedal is depressed. When recovering from such a fuel cutoff operation, it is required to promptly recover the engine output after the resumption of combustion. Therefore, when recovering from the fuel cutoff operation, in which all the cylinders of the engine 10 are deactivated, the pattern determining section 21 sets the subsequent combustion cylinder ratio γt to the target ratio γt irrespective of the value of ratio γn. That is, at the recovery from the fuel cutoff operation, the target deactivation interval Nt is set to the cylinder deactivation interval from the last cylinder deactivation in the fuel cutoff operation to the first cylinder deactivation after the recovery from the fuel cutoff operation, so that it is possible to recover the engine output promptly after the recovery from the fuel cutoff operation.

Second Embodiment

Next, a variable combustion cylinder ratio control device and method according to a second embodiment will be described. In the present embodiment, the same reference numerals are given to those components that the same as the corresponding components of the first embodiment and detailed description thereof is omitted.

The variable control device of the present embodiment is employed in a V6 engine, in which six cylinders are divided into two banks, the first bank and the second bank. In the following description, the three cylinders provided in the first bank are referred to as a cylinder #1, a cylinder #3, and a cylinder #5, and the three cylinders provided in the second bank are referred to as a cylinders #2, a cylinder #4, and a cylinder #6. In the engine 10, ignition is executed in the order of the cylinder #1, the cylinder #2, the cylinder #3, the cylinder #4, the cylinder 5, and the cylinder #6.

In the V engine as described above, if cylinders in which combustion is suspended during the intermittent deactivation operation concentrate on one of the two banks, the exhaust properties of the two banks may be uneven, which may make the emission control difficult. To address this problem, the present embodiment executes consecutively combustion deactivation during the intermittent deactivation operation for two cylinders at a time. Thus, combustion is deactivated in one cylinder at a time in each of the first bank and the second bank, which reduces the unevenness of the exhaust properties between the banks.

The variable control of the combustion cylinder ratio in the present embodiment employs eleven values of the combustion cylinder ratio: 0%, 50%, 60%, 67%, 71%, 75%, 80%, 83%, 86%, 88%, and 100%. Table 6 shows the order of combustion and deactivation of the cylinders for each of the eleven values of the combustion cylinder ratio. Among the combustion cylinder ratios shown in Table 6, the ratios used during the intermittent deactivation operation of the engine 10 are nine values: 50%, 60%, 67%, 71%, 75%, 80%, 83%, 86%, and 88%. With each of these combustion cylinder ratios, the cylinder deactivation is repeatedly executed in a pattern in which combustion is executed consecutively in N cylinders (N is an arbitrary natural number) in the order of the cylinders entering the combustion stroke, and then the subsequent two cylinders are deactivated.

TABLE 6

| Combustion | | Deactivation (—)/Combustion (○) | | | | | | | | | | | | | | | | | | | | | | | | |
|---|---|---|---|---|---|---|---|---|---|---|---|---|---|---|---|---|---|---|---|---|---|---|---|---|---|---|
| Cylinder Ratio | ID | #1 | #2 | #3 | #4 | #5 | #6 | #1 | #2 | #3 | #4 | #5 | #6 | #1 | #2 | #3 | #4 | #5 | #6 | #1 | #2 | #3 | #4 | #5 | #6 | ... |
| 0% | (0) | — | — | — | — | — | — | — | — | — | — | — | — | — | — | — | — | — | — | — | — | — | — | — | — | ... |
| 50% | 1 | ○ | ○ | — | — | ○ | ○ | — | — | ○ | ○ | — | — | ○ | ○ | — | — | ○ | ○ | — | — | ○ | ○ | — | — | ... |
| 60% | 2 | ○ | ○ | ○ | — | — | ○ | ○ | ○ | — | — | ○ | ○ | ○ | — | — | ○ | ○ | ○ | — | — | ○ | ○ | ○ | — | ... |
| 67% | 3 | ○ | ○ | ○ | ○ | — | — | ○ | ○ | ○ | ○ | — | — | ○ | ○ | ○ | ○ | — | — | ○ | ○ | ○ | ○ | — | — | ... |
| 71% | 4 | ○ | ○ | ○ | ○ | ○ | — | — | ○ | ○ | ○ | ○ | ○ | — | — | ○ | ○ | ○ | ○ | ○ | — | — | ○ | ○ | ○ | ... |
| 75% | 5 | ○ | ○ | ○ | ○ | ○ | ○ | — | — | ○ | ○ | ○ | ○ | ○ | ○ | — | — | ○ | ○ | ○ | ○ | ○ | ○ | — | — | ... |
| 80% | 6 | ○ | ○ | ○ | ○ | ○ | ○ | ○ | ○ | — | — | ○ | ○ | ○ | ○ | ○ | ○ | ○ | ○ | — | — | ○ | ○ | ○ | ○ | ... |
| 83% | 7 | ○ | ○ | ○ | ○ | ○ | ○ | ○ | ○ | ○ | ○ | — | — | ○ | ○ | ○ | ○ | ○ | ○ | ○ | ○ | ○ | ○ | — | — | ... |
| 86% | 8 | ○ | ○ | ○ | ○ | ○ | ○ | ○ | ○ | ○ | ○ | ○ | ○ | — | — | ○ | ○ | ○ | ○ | ○ | ○ | ○ | ○ | ○ | ○ | ... |
| 88% | 9 | ○ | ○ | ○ | ○ | ○ | ○ | ○ | ○ | ○ | ○ | ○ | ○ | ○ | ○ | — | — | ○ | ○ | ○ | ○ | ○ | ○ | ○ | ○ | ... |
| 100% | (10) | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ... |

As shown in Table 6, in the range from 50% to 75%, the combustion cylinder ratios used in the variable control are set such that the cylinder deactivation interval changes by an amount equivalent to one cylinder at a time. In contrast, in the range from 75% to 88%, the combustion cylinder ratios used in the variable control are set such that the cylinder deactivation interval changes by the amount equivalent to two cylinders at a time. That is, in the present embodiment, the minimum change amount of the cylinder deactivation interval when changing the combustion cylinder ratio is one cylinder between 50% and 75% and two cylinders between 75% and 88%.

As in the case of the first embodiment shown in FIG. 2, the electronic control unit 16, which includes the target ratio setting section 20, the pattern determining section 21, and the air amount adjusting section 22, is configured to execute the variable combustion cylinder ratio control. In the present embodiment, the calculation of the target ratio γt by the target ratio setting section 20 and the adjustment of the engine load factor KL in accordance with the combustion cylinder ratio by the air amount adjusting section 22 are executed in the same manner as in the first embodiment. The determination of the subsequent combustion cylinder ratio γn by the pattern determining section 21 is also executed in the same manner as in the first embodiment except that the contents of the calculation maps M1 to M3 used for the determination are different.

In the variable control device of the present embodiment, Tables 7 to 9 shown the relationship between the current combustion cylinder ratio γc and the combustion cylinder ratio that can be set as the subsequent combustion cylinder ratio γn in the low speed, middle speed, and high-speed calculation maps M1 to M3, which are used by the pattern determining section 21 to determine the subsequent combustion cylinder ratio γn.

TABLE 7

Low-Speed Calculation Map M1

| | | Subsequent Combustion Cylinder Ratio (○: Settable, —: Not Settable) | | | | | | | | | |
|---|---|---|---|---|---|---|---|---|---|---|---|
| | | 100% | 88% | 86% | 83% | 80% | 75% | 71% | 67% | 60% | 50% |
| Current Combustion Cylinder Ratio | 100% | ○ | ○ | ○ | ○ | ○ | — | — | — | — | — |
| | 88% | ○ | ○ | ○ | ○ | ○ | ○ | ○ | ○ | — | — |
| | 86% | ○ | ○ | ○ | ○ | ○ | ○ | ○ | ○ | — | — |
| | 83% | ○ | ○ | ○ | ○ | ○ | ○ | ○ | ○ | — | — |
| | 80% | — | ○ | ○ | ○ | ○ | ○ | ○ | ○ | — | — |
| | 75% | — | ○ | ○ | ○ | ○ | ○ | ○ | ○ | ○ | — |
| | 71% | — | ○ | ○ | ○ | ○ | ○ | ○ | ○ | ○ | — |
| | 67% | — | — | — | — | ○ | ○ | ○ | ○ | ○ | — |
| | 60% | — | — | — | — | — | — | ○ | ○ | ○ | ○ |
| | 50% | — | — | — | — | — | — | — | — | ○ | ○ |

TABLE 8

Middle-Speed Calculation Map M2

| | | Subsequent Combustion Cylinder Ratio (○: Settable, —: Not Settable) | | | | | | | | | |
|---|---|---|---|---|---|---|---|---|---|---|---|
| | | 100% | 88% | 86% | 83% | 80% | 75% | 71% | 67% | 60% | 50% |
| Current Combustion Cylinder Ratio | 100% | ○ | ○ | ○ | — | — | — | — | — | — | — |
| | 88% | ○ | ○ | ○ | ○ | ○ | ○ | — | — | — | — |
| | 86% | — | ○ | ○ | ○ | ○ | ○ | — | — | — | — |
| | 83% | — | ○ | ○ | ○ | ○ | ○ | ○ | — | — | — |
| | 80% | — | ○ | ○ | ○ | ○ | ○ | ○ | — | — | — |
| | 75% | — | — | ○ | ○ | ○ | ○ | ○ | ○ | — | — |
| | 71% | — | — | — | — | ○ | ○ | ○ | ○ | — | — |
| | 67% | — | — | — | — | — | ○ | ○ | ○ | ○ | — |
| | 60% | — | — | — | — | — | — | — | ○ | ○ | ○ |
| | 50% | — | — | — | — | — | — | — | — | ○ | ○ |

TABLE 9

High-Speed Calculation Map M3

| | | Subsequent Combustion Cylinder Ratio (○: Settable, —: Not Settable) | | | | | | | | | |
|---|---|---|---|---|---|---|---|---|---|---|---|
| | | 100% | 88% | 86% | 83% | 80% | 75% | 71% | 67% | 60% | 50% |
| Current Combustion Cylinder Ratio | 100% | ○ | ○ | — | — | — | — | — | — | — | — |
| | 88% | ○ | ○ | ○ | — | — | — | — | — | — | — |
| | 86% | — | ○ | ○ | ○ | — | — | — | — | — | — |
| | 83% | — | — | ○ | ○ | ○ | — | — | — | — | — |
| | 80% | — | — | — | ○ | ○ | ○ | — | — | — | — |
| | 75% | — | — | — | — | ○ | ○ | ○ | — | — | — |
| | 71% | — | — | — | — | — | ○ | ○ | ○ | — | — |
| | 67% | — | — | — | — | — | — | ○ | ○ | ○ | — |
| | 60% | — | — | — | — | — | — | — | ○ | ○ | ○ |
| | 50% | — | — | — | — | — | — | — | — | ○ | ○ |

TABLE 10

| | | Combustion Cylinder Ratio after Change | | | | | | | | | |
|---|---|---|---|---|---|---|---|---|---|---|---|
| | | 100% (n = ∞) | 88% (n = 14) | 86% (n = 12) | 83% (n = 10) | 80% (n = 8) | 75% (n = 6) | 71% (n = 5) | 67% (n = 4) | 60% (n = 3) | 50% (n = 2) |
| Combustion Cylinder Ratio before Change | 100% (n = ∞) | 0.0% | 12.5% | 14.3% | 16.7% | 20.0% | 25.0% | 28.6% | 33.3% | 40.0% | 50.0% |
| | 88% (n = 14) | 14.3% | 0.0% | 2.0% | 4.8% | 8.6% | 14.3% | 18.4% | 23.8% | 31.4% | 42.9% |
| | 86% (n = 12) | 16.7% | 2.1% | 0.0% | 2.8% | 6.7% | 12.5% | 16.7% | 22.2% | 30.0% | 41.7% |
| | 83% (n = 10) | 20.0% | 5.0% | 2.9% | 0.0% | 4.0% | 10.0% | 14.3% | 20.0% | 28.0% | 40.0% |
| | 80% (n = 8) | 25.0% | 9.4% | 7.1% | 4.2% | 0.0% | 6.3% | 10.7% | 16.7% | 25.0% | 37.5% |
| | 75% (n = 6) | 33.3% | 16.7% | 14.3% | 11.1% | 6.7% | 0.0% | 4.8% | 11.1% | 20.0% | 33.3% |
| | 71% (n = 5) | 40.0% | 22.5% | 20.0% | 16.7% | 12.0% | 5.0% | 0.0% | 6.7% | 16.0% | 30.0% |
| | 67% (n = 4) | 50.0% | 31.3% | 28.6% | 25.0% | 20.0% | 12.5% | 7.1% | 0.0% | 10.0% | 25.0% |
| | 60% (n = 3) | 66.7% | 45.8% | 42.9% | 38.9% | 33.3% | 25.0% | 19.0% | 11.1% | 0.0% | 16.7% |
| | 50% (n = 2) | 100.0% | 75.0% | 71.4% | 66.7% | 60.0% | 50.0% | 42.9% | 33.3% | 20.0% | 0.0% |

In contrast, Table 10 shows a rate of change Δγ of the combustion cylinder ratio before and after the combustion cylinder ratio is changed among 50%, 60%, 67%, 71%, 75%, 80%, 83%, 86%, 88%, and 100%. As can be seen from the above, in the calculation maps M1 to M3 employed in the present embodiment, the combustion cylinder ratio in which the difference between the identification number of the cylinder deactivation pattern and the current combustion cylinder ratio γc is less than or equal to one can be set as the subsequent combustion cylinder ratio γn irrespective of the value of the current combustion cylinder ratio γc. That is, the ratio equal to the current combustion cylinder ratio γc and the ratio in which the difference between the current combustion cylinder ratio γc and the cylinder deactivation interval is the minimum change amount of the interval can be set as the subsequent combustion cylinder ratio γn. In the present embodiment, the minimum change amount of the cylinder deactivation interval when changing the combustion cylinder ratio is one cylinder in the range of the combustion cylinder ratio between 50% and 75% and two cylinders in the range of the combustion cylinder ratio between 75% and 88%.

In addition, in the low-speed calculation map M1, the combustion cylinder ratio in which the rate of change Δγ of the combustion cylinder ratio before and after a change is less than 25% is the ratio that can be set as the subsequent combustion cylinder ratio γn. In the middle-speed calculation map M2, the combustion cylinder ratio in which the rate of change Δγ of the combustion cylinder ratio before and after a change is less than 15% is the ratio that can be set as the subsequent combustion cylinder ratio γn.

As described above, in the present embodiment, when the target ratio γt is changed significantly, the cylinder deactivation interval is gradually changed in a plurality of times such that the combustion cylinder ratio is changed from the target ratio γt before the change to the target ratio γt after the change. When the engine speed NE is low or when the change of the engine speed NE is great, the number of times of changes of the cylinder deactivation interval up to the target ratio γt after the changes is reduced. This suppresses the engine speed fluctuation due to a change of the cylinder deactivation interval when variably controlling the combustion cylinder ratio, while suppressing deterioration of responsiveness of the variable control.

The illustrated embodiments may be modified as follows.

In the above-described embodiments, the required load factor KLT of the engine 10 is adjusted in accordance with a change of the combustion cylinder ratio by the air amount adjusting section 22. However, such adjustment does not necessarily need to be executed. Even in such a case, it is possible to suppress the engine speed fluctuation caused by changing the cylinder deactivation interval during the variable combustion cylinder ratio control as long as the change amount of the cylinder deactivation interval when changing the combustion cylinder ratio is limited to X cylinders or less and the value of X is set to a variable value that changes in accordance with the operating state of the engine 10.

In the above-described embodiments, when recovering from the fuel cutoff operation, combustion is resumed with the target ratio γt set to the combustion cylinder ratio from the beginning. That is, during a fuel cutoff operation, the value of the target ratio γt is set as the value of the subsequent combustion cylinder ratio γn. When the target ratio γt is changed to a value other than 0% due to recovery from the fuel cutoff operation, the value of the changed target ratio γt is set as the value of the subsequent combustion cylinder ratio γn. Such exceptional operation may be omitted, and even when recovering from the fuel cutoff operation, the subsequent combustion cylinder ratio γn may be calculated by using the calculation map M1 to M3 as usual. In such a case, when recovering from the fuel cutoff operation, combustion is restarted with the combustion cylinder ratio set to 50%. Thereafter, variable control of the combustion cylinder ratio is executed in such a manner that the combustion cylinder ratio is gradually changed so as to approach the target ratio γt.

In the above-described embodiments, the calculation map used to calculate the subsequent combustion cylinder ratio γn is switched between the three calculation maps M1 to M3 in accordance with the engine speed NE and its change amount ΔNE. The number of such calculation maps and the conditions for switching the maps may be changed as necessary.

In the above-described embodiments, the calculation map used to calculate the subsequent combustion cylinder ratio γn is switched in accordance with the engine speed NE and its change amount ΔNE. However, the switching of such calculation map may be executed based on only one of the engine speed NE and its change amount ΔNE.

In the above-described embodiments, the range of the combustion cylinder ratio that can be set as the subsequent combustion cylinder ratio γn is obtained by using the previously stored calculation maps. However, the range may be calculated each time the subsequent combustion cylinder ratio γn is calculated.

In the above-described embodiments, for the variable value X, which varies in accordance with the current combustion cylinder ratio γc, the engine speed NE, and its change amount ΔNE, the subsequent combustion cylinder ratio γn is determined such that the subsequent deactivation interval Nn becomes a cylinder deactivation interval within X cylinders in relation to the current deactivation interval Nc. That is, three parameters, or the current combustion cylinder ratio γc, the engine speed NE, and its change amount ΔNE, are used as parameters indicating the operating state of the engine 10, which determines the value of the variable value X. Other parameters indicating the operating state of the engine 10, such as the vehicle speed and acceleration may be added to the parameters that determine the value of the variable value X. In any case, if the variable value X has the property shown below, it is possible to suppress the engine speed fluctuation accompanying a change of the cylinder deactivation interval when variably controlling the combustion cylinder ratio. That is, if the speed fluctuation of the engine 10 when changing the cylinder deactivation interval is likely to increase, the variable value X is smaller than when the speed fluctuation is unlikely to increase. When the speed fluctuation of the engine 10 is likely to lead to deterioration of drivability, the variable value X has a smaller value than otherwise.

In each of the above-described embodiments, combustion in the cylinder is suspended by stopping fuel injection and ignition. If the configuration is applied to an engine in which a valve lock mechanism, which stops opening of intake/exhaust valves is provided in each cylinder, the variable combustion cylinder ratio control devices of the above described embodiments can be configured to skip combustion in the cylinders by stopping the opening operation of the intake/exhaust valves using the valve lock mechanism.

The electronic control unit 16 (the target ratio setting section 20 and the pattern determining section 21) is not limited to a device that includes a CPU and a ROM and executes software processing. For example, at least part of the processes executed by the software in the above-illustrated embodiments may be executed by hardware circuits dedicated to executing these processes (such as ASIC). That is, the electronic control unit 16 may be modified as long as it has any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Therefore, the present examples and embodiments are to be considered as illustrative and not restrictive and the disclosure is not to be limited to the examples and embodiments given herein.

The invention claimed is:

1. A variable combustion cylinder ratio control device configured to variably control a combustion cylinder ratio of an engine during an intermittent deactivation operation in which cylinder deactivation is intermittently executed, the combustion cylinder ratio being a ratio of (i) a number of combustion cylinders in which combustion is executed to (ii) a sum of the number of the combustion cylinders in which combustion is executed and a number of cylinders in which combustion is suspended in a cylinder deactivation pattern, the cylinder deactivation pattern being an order of combustion and deactivation of the cylinders, the cylinder deactivation pattern varying based on the combustion cylinder ratio, the variable combustion cylinder ratio control device comprising:

an electronic control unit configured to:

(1) set a target ratio corresponding to a target value of the combustion cylinder ratio, the target value of the combustion cylinder ratio corresponding to regularly repeating cylinder deactivations;

(2) change a cylinder deactivation number indicating a number of cylinders in which combustion is consecutively executed between one deactivation and a subsequent deactivation of the regularly repeating cylinder deactivations, the cylinder deactivation number being changed from a current deactivation number to a subsequent deactivation number, the subsequent deactivation number being one of:

(2i) an intermediate cylinder deactivation number that is between the current deactivation number and a target deactivation number, the current deactivation number corresponding to a current combustion cylinder ratio, the target deactivation number corresponding to the target ratio, and (2ii) the target deactivation number;

(3) determine a subsequent cylinder deactivation pattern of the engine based on the subsequent deactivation number by:

(3i) setting the target deactivation number as the subsequent deactivation number when a difference between the current deactivation number and the target deactivation number is less than or equal to X cylinders in which combustion is consecutively executed, X being a natural number and X having a value that varies in accordance with an operating state of the engine, and (3ii) setting the intermediate deactivation number as the subsequent deactivation number when the difference between the current deactivation number and the target deactivation number exceeds X cylinders, the intermediate deactivation number being X cylinders closer to the target deactivation number than is the current deactivation number; and (4) execute the determined subsequent cylinder deactivation pattern in the engine including controlling the combustion cylinders of the engine to deactivate based on the determined subsequent cylinder deactivation pattern.

2. The variable combustion cylinder ratio control device according to claim 1, wherein the value of X has an inverse relationship with an engine speed.

3. The variable combustion cylinder ratio control device according to claim 1, wherein the value of X has a direct relationship with the current deactivation number.

4. The variable combustion cylinder ratio control device according to claim 1, wherein the value of X has a direct relationship with a magnitude of change of an engine speed.

5. The variable combustion cylinder ratio control device according to claim 1, wherein the electronic control unit is configured to define, in response to the engine recovering from a fuel cutoff operation in which all the cylinders of the engine are deactivated, the target deactivation number to be a cylinder deactivation number from a last cylinder deactivation in the fuel cutoff operation to a first cylinder deactivation after the engine recovers from the fuel cutoff operation.

6. The variable combustion cylinder ratio control device according to claim 1, wherein the electronic control unit is configured to set the cylinder deactivation number when executing a first cylinder deactivation after switching from an all-cylinder combustion operation in which combustion is executed in all the cylinders to the intermittent deactivation operation, and set the cylinder deactivation number when executing a last cylinder deactivation before switching from the intermittent deactivation operation to the all-cylinder combustion operation, the cylinder deactivation number being set to lower values when an engine speed is lower than values when the engine speed is higher.

7. The variable combustion cylinder ratio control device according to claim 1, wherein the electronic control unit is configured to set the cylinder deactivation number when executing a first cylinder deactivation after switching from an all-cylinder combustion operation in which combustion is executed in all of the cylinders to the intermittent deactivation operation, and set the cylinder deactivation number when executing a last cylinder deactivation before switching from the intermittent deactivation operation to the all-cylinder combustion operation, the cylinder deactivation number being set to lower values when a magnitude of a change of an engine speed is lower than values when the magnitude of the change of the engine speed is higher.

8. The variable combustion cylinder ratio control device according to claim 1, wherein the value of X is the greater one of:

a value at which a rate of change of the combustion cylinder ratio when the cylinder deactivation number is changed from the current deactivation number to the subsequent deactivation number is less than a preset limit value, and a minimum change amount of the cylinder deactivation number.

9. The variable combustion cylinder ratio control device according to claim 8, wherein the limit value has an inverse relationship with an engine speed.

10. The variable combustion cylinder ratio control device according to claim 8, wherein the limit value has a direct relationship with a magnitude of change of an engine speed.

11. A variable combustion cylinder ratio control method for variably controlling a combustion cylinder ratio of an engine during an intermittent deactivation operation in which cylinder deactivation is intermittently executed, the combustion cylinder ratio being a ratio of (i) a number of combustion cylinders in which combustion is executed to (ii) a sum of the number of the combustion cylinders in which combustion is executed and a number of cylinders in which combustion is suspended in a cylinder deactivation pattern, the cylinder deactivation pattern being an order of combustion and deactivation of the cylinders, the cylinder deactivation pattern varying based on the combustion cylinder ratio, the variable combustion cylinder ratio control method comprising:

(1) setting a target ratio corresponding to a target value of the combustion cylinder ratio, the target value of the combustion cylinder ratio corresponding to regularly repeating cylinder deactivations;

(2) changing a cylinder deactivation number indicating a number of cylinders in which combustion is consecutively executed between one deactivation and a subsequent deactivation of the regularly repeating cylinder deactivations, the cylinder deactivation number being changed from a current deactivation number to a subsequent deactivation number, the subsequent deactivation number being one of:

(2i) an intermediate cylinder deactivation number that is between the current deactivation number and a target deactivation number, the current deactivation number corresponding to a current combustion cylinder ratio, the target deactivation number corresponding to the target ratio, and (2ii) the target deactivation number;

(3) determining a subsequent cylinder deactivation pattern of the engine based on subsequent deactivation number by:

(3i) setting the target deactivation number as the subsequent deactivation number when a difference between the current deactivation number and the target deactivation number is less than or equal to X cylinders in which combustion is consecutively executed, X being a natural number and X having a value that varies in accordance with an operating state of the engine, and (3ii) setting the intermediate deactivation number as the subsequent deactivation number when the difference between the current deactivation number and the target deactivation number exceeds X cylinders, the intermediate deactivation number being X cylinders closer to the target deactivation number than is the current deactivation number; and (4) executing the determined subsequent cylinder deactivation pattern in the engine including controlling the combustion cylinders of the engine to deactivate based on the determined subsequent cylinder deactivation pattern.

12. A variable combustion cylinder ratio control device configured to variably control a combustion cylinder ratio of an engine during an intermittent deactivation operation in which cylinder deactivation is intermittently executed, the combustion cylinder ratio being a ratio of (i) a number of combustion cylinders in which combustion is executed to (ii) a sum of the number of the combustion cylinders in which combustion is executed and a number of cylinders in which combustion is suspended in a cylinder deactivation pattern, the cylinder deactivation pattern being an order of combustion and deactivation of the cylinders, the cylinder deactivation pattern varying based on the combustion cylinder ratio, the variable combustion cylinder ratio control device comprising processing circuitry configured to:

(1) set a target ratio corresponding to a target value of the combustion cylinder ratio, the target value of the combustion cylinder ratio corresponding to regularly repeating cylinder deactivations;

(2) change a cylinder deactivation number indicating a number of cylinders in which combustion is consecutively executed between one deactivation and a subsequent deactivation of the regularly repeating cylinder deactivations, the cylinder deactivation number being changed from a current deactivation number to a subsequent deactivation number, the subsequent deactivation number being one of:

(2i) an intermediate cylinder deactivation number that is between the current deactivation number and a target deactivation number, the current deactivation number corresponding to a current combustion cylinder ratio, the target deactivation number corresponding to the target ratio, and (2ii) the target deactivation number;

(3) determine a subsequent cylinder deactivation pattern of the engine based on the subsequent deactivation number by:

(3i) setting the target deactivation number as the subsequent deactivation number when a difference between the current deactivation number and the target deactivation number is less than or equal to X cylinders in which combustion is consecutively executed, X being a natural number and X having a value that varies in accordance with an operation state of the engine, and (3ii) setting the intermediate deactivation number as the subsequent deactivation number when the difference between the current deactivation number and the target deactivation number exceeds X cylinders, the intermediate deactivation number being X cylinders closer to the target deactivation number than is the current deactivation number; and (4) execute the determined subsequent cylinder deactivation pattern in the engine including controlling the combustion cylinders of the engine to deactivate based on the determined subsequent cylinder deactivation pattern.

* * * * *